US010358316B2

(12) United States Patent
Kotzur

(10) Patent No.: US 10,358,316 B2
(45) Date of Patent: Jul. 23, 2019

(54) APPARATUS AND METHODS FOR WINDING AND CUTTING WIRE OR CABLE

(71) Applicant: REELEX Packaging Solutions, Inc., Patterson, NY (US)

(72) Inventor: Scott William Kotzur, Carmel, NY (US)

(73) Assignee: REELEX Packaging Solutions, Inc., Patterson, NY (US)

( * ) Notice: Subject to any disclaimer, the term of this patent is extended or adjusted under 35 U.S.C. 154(b) by 135 days.

(21) Appl. No.: 15/464,930

(22) Filed: Mar. 21, 2017

(65) Prior Publication Data

US 2018/0273339 A1 Sep. 27, 2018

(51) Int. Cl.

| | |
|---|---|
| ***B65H 54/28*** | (2006.01) |
| ***B65H 54/71*** | (2006.01) |
| ***B65H 55/04*** | (2006.01) |
| ***B65H 67/044*** | (2006.01) |
| ***B65H 67/048*** | (2006.01) |

(Continued)

(52) U.S. Cl.

CPC ..... *B65H 67/048* (2013.01); *B65H 54/28* (2013.01); *B65H 54/71* (2013.01); *B65H 55/043* (2013.01); *B65H 67/044* (2013.01); *B65H 75/22* (2013.01); *B65H 75/242* (2013.01); *B65H 2701/36* (2013.01)

(58) Field of Classification Search

CPC . B65H 67/048; B65H 55/043; B65H 2701/36
See application file for complete search history.

(56) References Cited

U.S. PATENT DOCUMENTS

| | | | | |
|---|---|---|---|---|
| 2,634,922 A | | 4/1953 | Taylor, Jr. | |
| 4,147,310 A | * | 4/1979 | Harden | B65H 65/00 242/125.1 |
| 4,491,282 A | | 1/1985 | Hubner | |

(Continued)

FOREIGN PATENT DOCUMENTS

DE 1278608 B 9/1968

OTHER PUBLICATIONS

D-2000 Automated REELEX Packaging Machine, REELEX Packaging Solutions, Inc., Retrieved from https://www.youtube.com/watch?v=xHVIXiQvwZ4, Published Apr. 25, 2014, Most relevant part 2:38-2:58.

(Continued)

*Primary Examiner* — William E Dondero
(74) *Attorney, Agent, or Firm* — Gordon & Jacobson, P.C.

(57) ABSTRACT

A system for winding wire includes a wire take-up unit and a wire cutter/grabber unit. The take-up unit includes rotatable first and second mandrel portions, and a wire directing traverse arranged to feed wire and alternately form coils on the first and second mandrel portions. The cutter/grabber unit is configured to cut the wire at a cut position between the traverse and a coil formed on the first mandrel portion and to grab a free end of the cut wire and move along a predefined cutter/grabber pathway to a hand-off position where the wire is transferred to the second mandrel portion. As the cutter/grabber is moved along the pathway from the cut to the hand-off position, a length of wire between the traverse and the free end of the wire does not decrease, and that length of wire is longer at the hand-off position than at the cut position.

22 Claims, 30 Drawing Sheets

(51) Int. Cl.
*B65H 75/22* (2006.01)
*B65H 75/24* (2006.01)

(56) References Cited

U.S. PATENT DOCUMENTS

| | | | | |
|---|---|---|---|---|
| 6,776,627 | B2 * | 8/2004 | Hohner ..... | H01R 13/745<br>439/567 |
| 2003/0014942 | A1 | 1/2003 | Kotzur et al. | |
| 2003/0173448 | A1 | 9/2003 | Angold et al. | |
| 2016/0083217 | A1 | 3/2016 | Kotzur et al. | |
| 2016/0311640 | A1 | 10/2016 | Moore | |

OTHER PUBLICATIONS

International Search Report dated Aug. 1, 2018 for International Application No. PCT/US 18/23117.

* cited by examiner

APPARATUS AND METHODS FOR WINDING AND CUTTING WIRE OR CABLE

BACKGROUND

1. Field

This application relates to apparatus and methods for winding coils and dispensing coils after they are wound. More particularly, this application relates to an apparatus and methods for resetting a coil winding apparatus between windings of coils.

2. State of the Art

U.S. Pat. No. 2,634,922 to Taylor describes the winding of flexible wire, cable or filamentary material (hereinafter "wire", which is to be broadly understood in the specification and claims) around a mandrel in a figure-eight pattern such that a package of material is obtained having a plurality of layers surrounding a central core space. By rotating the mandrel and by controllably moving a traverse that guides the wire laterally relative to mandrel, the layers of the figure-eight pattern are provided with aligned holes (cumulatively a "pay-out hole") such that the inner end of the flexible material may be drawn out through the payout hole. When a package of wire is wound in this manner, the wire may be unwound through the payout hole without rotating the package, without imparting a rotation in the wire around its axis (i.e., twisting), and without kinking. This provides a major advantage to the users of the wire. Coils that are wound in this manner and dispense from the inside-out without twists, tangles, snags or overruns are known in the art as REELEX (a trademark of Reelex Packaging Solutions, Inc.)-type coils. REELEX-type coils are wound to form a generally short hollow cylinder with a radial opening formed at one location in the middle of the cylinder. A payout tube may be located in the radial opening and the end of the wire making up the coil may be fed through the payout tube for ease in dispensing the wire.

A REELEX model D2000 coiling machine (manufactured by Reelex Packaging Solutions, Inc.) is available to wind wire into REELEX-type coils. The machine has a set of mandrels that alternate positions between a winding position and a packaging position. The coil is wound in the winding position and a finished coil is moved off a mandrel to be packaged in the packaging position. The positions are alternated by a rotating turret to which the mandrels are attached. Between the winding of each coil, a resetting process is performed to ready the machine to wind another coil. Generally, the process includes: cutting a supply wire used in making a first wound coil at an end of the coil; grabbing a free end of supply wire; and handing off the free end of the supply wire to the mandrel as the beginning of a new coil to be wound.

The D2000 machine uses a "cutter/grabber" device that is supported below the cutter/grabber on linear rails of a support structure which can move the cutter/grabber in three orthogonal directions. The cutter/grabber device is configured to cut wire and grab cable. When a first coil on a mandrel is finished winding, the cutter/grabber moves to a cut position and cuts the wire to separate the coil from the supply wire, and the grabber captures the free end of the supply wire. The mandrel, being a two part assembly, separates so that an outer portion moves axially away from an inner portion that retains the coil. Next, the cutter/grabber moves out of the way of the coil and the inner portion of the mandrel, which is mounted on a rotating turret. Then, the turret rotates in a horizontal plane to exchange positions with an empty inner mandrel portion. Then, the cutter/grabber moves back toward the empty inner mandrel portion to deliver the wire to be grabbed by the inner mandrel portion. Once the inner mandrel portion captures the wire (a "hand-off") the cutter/grabber releases the wire and moves out of the way of the mandrel so that the outer portion of the mandrel can be joined with the inner portion of the mandrel to form a complete mandrel to begin spinning for coiling wire. The resetting process takes about six to seven seconds, which is about ten percent of the total time of winding the coil. Such a relatively lengthy process impacts the throughput of the coiling machine.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

One embodiment of a system for winding a wire includes a wire take-up unit and a wire cutter/grabber unit. The wire take-up unit includes a rotatable first mandrel portion, a rotatable second mandrel portion, a third mandrel portion which is configured to alternately join with the first and second mandrel portions to form a complete mandrel on which to wind wire into a coil, and a wire directing traverse. The traverse is arranged to feed wire and alternately form coils on either of the complete mandrels. Each coil is wound in a figure-eight configuration. The wire cutter/grabber unit is configured to cut the wire at a cut position between the traverse and a coil formed on the first mandrel portion and to grab a free end of the cut wire and move along a predefined cutter/grabber pathway to a hand-off position where the wire is transferred to the second mandrel portion, which is empty. As the cutter/grabber is moved along the cutter/grabber pathway from the cut position to the hand-off position, a length of wire between the traverse and the free end of the wire does not decrease, and the length of wire between the traverse and the free end of the wire is longer at the hand-off position than at the cut position.

In one embodiment, the cutter/grabber is configured to move from a wait-to-cut position to the cut position, and the wait-to-cut position is within six inches of the traverse, and is preferably within three inches of the traverse. In one embodiment, the first and second mandrel portions may each include a grabber configured to grab the wire when the cutter/grabber is in the hand-off position.

In one embodiment, the system includes a cutter/grabber positioning system disposed vertically above the cutter/grabber and configured to position the cutter/grabber along the cutter/grabber pathway. The positioning system may include a multi jointed arm configured to articulate in a plane that is transverse to a plane in which the traverse is configured to move and may include a first drive unit configured to articulate the arm.

The positioning system may include a second drive unit configured to translate the arm and the first drive unit in a direction parallel to an axis along which the traverse is configured to travel. In one embodiment, the positioning system is configured to maintain the cutter/grabber in a horizontal orientation as the cutter/grabber moves throughout the cutter/grabber pathway.

According to one aspect, a wire cutter/grabber unit is configured to move along a cutter/grabber pathway to separate a coil that is wound about a first mandrel portion from a supply wire drawn through a moving traverse, and to set up a second, empty mandrel portion for winding the supply wire about the second mandrel portion into another coil. The first and second mandrel portions alternately join a third mandrel portion to form complete mandrels for winding the supply of wire into a coil. The pathway includes a plurality of distinct positions including a wait-to-cut position, a cut position, a transfer position, a hand-off position, and a ready-to-wind position. The cutter/grabber may move sequentially from the wait-to-cut position to the cut position, to the transfer position, to the hand-off position, to the ready-to-wind position, and back to the wait-to-cut position.

At the cut position, the cutter/grabber may cut the supply wire between the coil on the first mandrel portion and the traverse, and grab a free end of the cut the wire from the traverse. At the transfer position, the cutter/grabber can hold the free end of the wire while the first and third mandrel portions separate, followed by the first and second mandrel portions exchanging places relative to the traverse. At the hand-off position, the cutter/grabber and the traverse may be relatively positioned to extend the wire across a grabber of the second mandrel portion.

In one embodiment, the ready-to-wind position is vertically below the hand-off position and the second mandrel portion. When the cutter/grabber is at the ready-to-wind position, the third mandrel portion can join the second mandrel portion to form a complete mandrel on which a coil can be wound. In one embodiment, as the cutter/grabber is moved along the cutter/grabber pathway from the cut position to the hand-off position, a length of wire between the traverse and the free end of the wire does not decrease, and the length of wire between the traverse and the free end of the wire is longer at the hand-off position than at the cut position.

According to another aspect, a system for winding wire includes a wire take-up unit, as discussed above, a wire cutter/grabber unit, and a cutter/grabber positioning system. The wire cutter/grabber unit is configured to cut the wire at a cut position between the traverse and the coil and to grab a free end of the cut wire and move along a predefined cutter/grabber pathway to a hand-off position where the wire is transferred to the second mandrel portion that is empty. As the cutter/grabber is moved along the cutter/grabber pathway from the cut position to the hand-off position, the length of wire between the traverse and the free end of the wire does not decrease, and the length of wire between the traverse and the free end of the wire is longer at the hand-off position than at the cut position.

The cutter/grabber positioning system is coupled to the wire take-up unit at an upper end and is coupled to the cutter/grabber at a lower end. The cutter/grabber positioning system is disposed vertically above the cutter/grabber and is configured to position the cutter/grabber along the cutter/grabber pathway. The positioning system includes a multi-jointed arm having an upper arm and a lower arm configured to pivot relative to one another in a plane common to the upper and lower arms. The positioning system also includes a first drive unit configured to rotate at least one of the upper and lower arms, and a second drive unit configured to translate the arm and the first drive unit in a direction parallel to the traverse. The positioning system is configured to maintain the cutter/grabber in a horizontal orientation as the cutter/grabber moves throughout the cutter/grabber pathway.

The arm may include a belt driven transmission system driven by the first drive unit. The first drive unit may include a shoulder drive unit and an elbow drive unit. The shoulder drive unit may be configured to rotate the upper arm about a shoulder joint of the arm. The elbow drive unit may be configured to rotate the lower arm about an elbow joint of the arm between the upper arm and the lower arm. The first drive unit may be mounted on fixed rails for translation of the first drive unit in a direction parallel to the traverse.

The shoulder drive unit may include a shoulder driver including a stepper motor configured to drive geared belts connected to geared shoulder pulleys fixed to the upper arm, and the elbow drive unit includes an elbow driver including a stepper motor configured to drive geared belts connected to geared elbow pulleys fixed to the lower arm. The second drive unit may include an air cylinder configured to translate the first drive unit and the arm.

DETAILED DESCRIPTION

Figure 1:
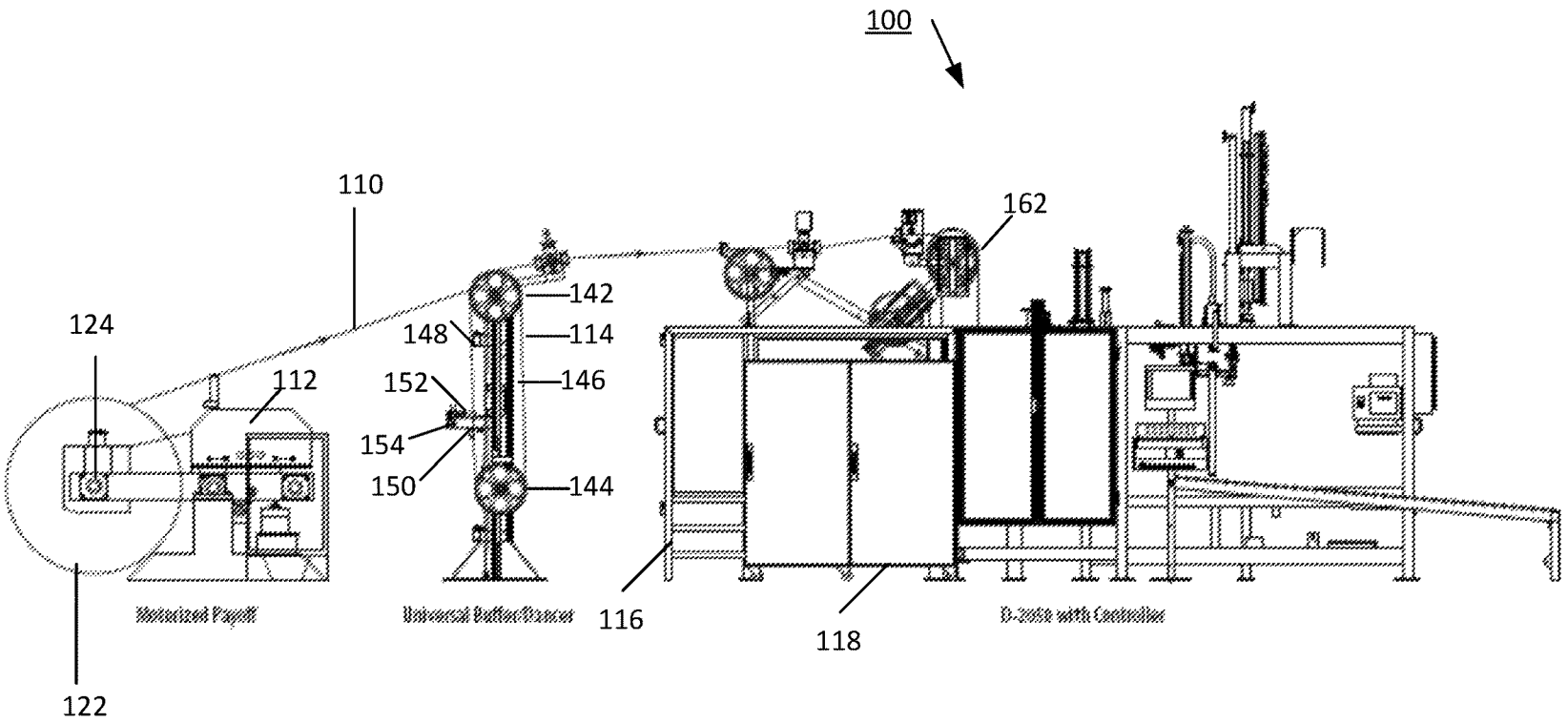
FIG. 1 is a schematic illustration of a REELEX-type winding system.

One embodiment of a winding system 100 for winding wire 110 is seen in FIG. 1. System 100 is a REELEX-type winding system and is shown with a payoff or payout unit 112, a dancer/accumulator (tensioner) 114, a take-up unit 116 (hereinafter "winding machine"), and a controller 118. Each of these elements will be described in more detail hereinafter.

To start, it should be appreciated that the payoff unit 112 is shown as including a large source reel 122 of wire 110 and a motor 124 that is used to control the speed at which the wire 110 is dispensed off of the reel 122. The dancer/accumulator or tensioner 114 is shown with upper sheaves 142 and lower sheaves 144 around which the wire 110 wraps, a pneumatic cylinder 146 that applies pressure to the lower sheaves 144 of the tensioner 114 to effect a desired tension, and a distance or height sensor 148 (e.g., a laser system) that senses the location of the lower sheave 144 relative to the upper sheave 142. The height sensor 148 is coupled to the payoff unit 112 and can provide feedback information to the payoff unit 112, thereby informing the payoff unit to increase its speed if the amount of wire in the accumulator is low, and informing the payoff unit to decrease its speed if the amount of wire in the accumulator is high. In another embodiment, the feedback information may be provided to the take-up unit 116 and used to decrease or increase the speed thereof. In one embodiment the pneumatic cylinder 146 that applies tension to the wire 110 may be controlled by a digital self-relieving air regulator 150 that includes a digital regulator 152 in line with a self-relieving pressure relay 154.

Figure 1A:
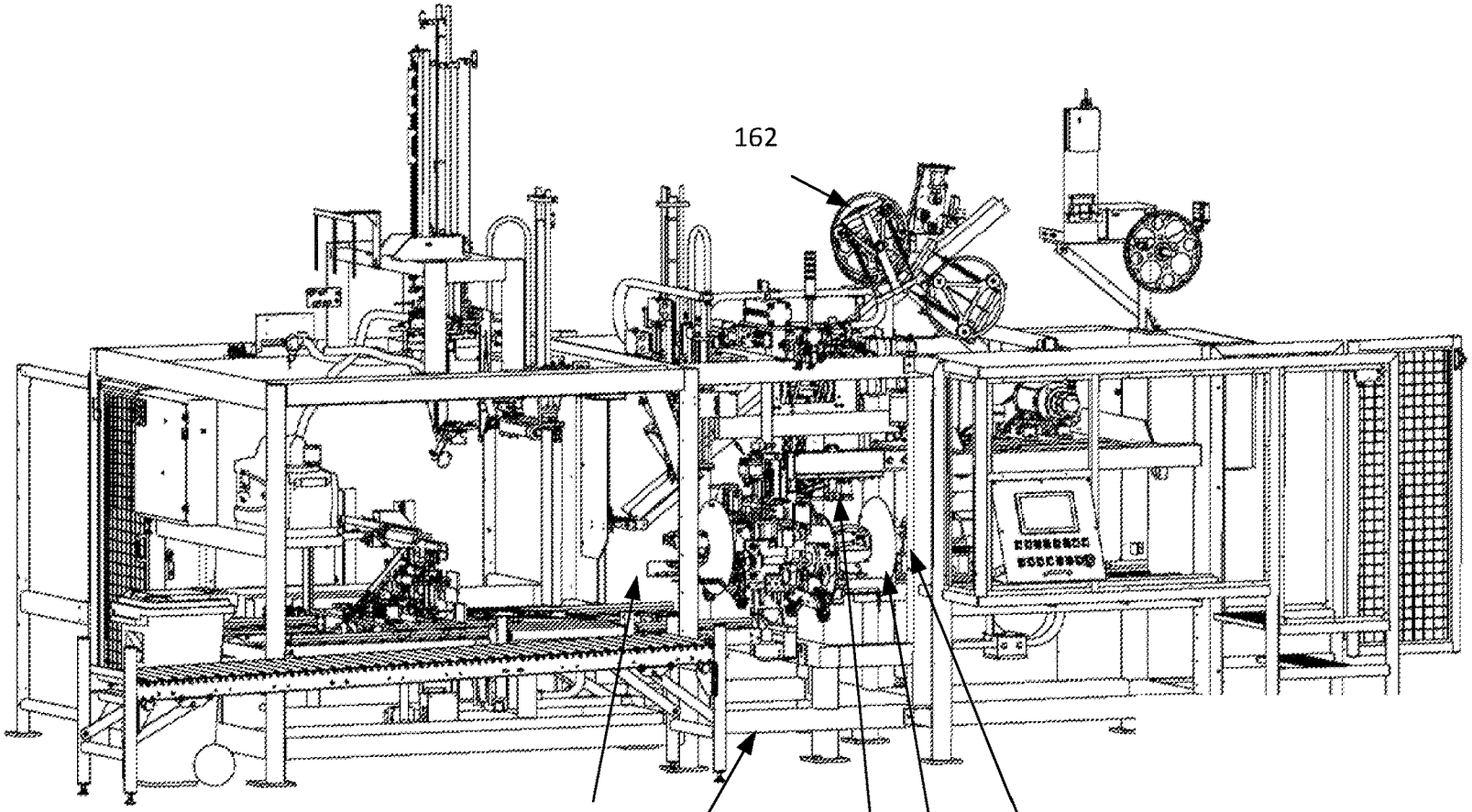
FIG. 1A is an embodiment of a REELEX-type winding apparatus of the winding system shown in FIG. 1.
Figure 2:
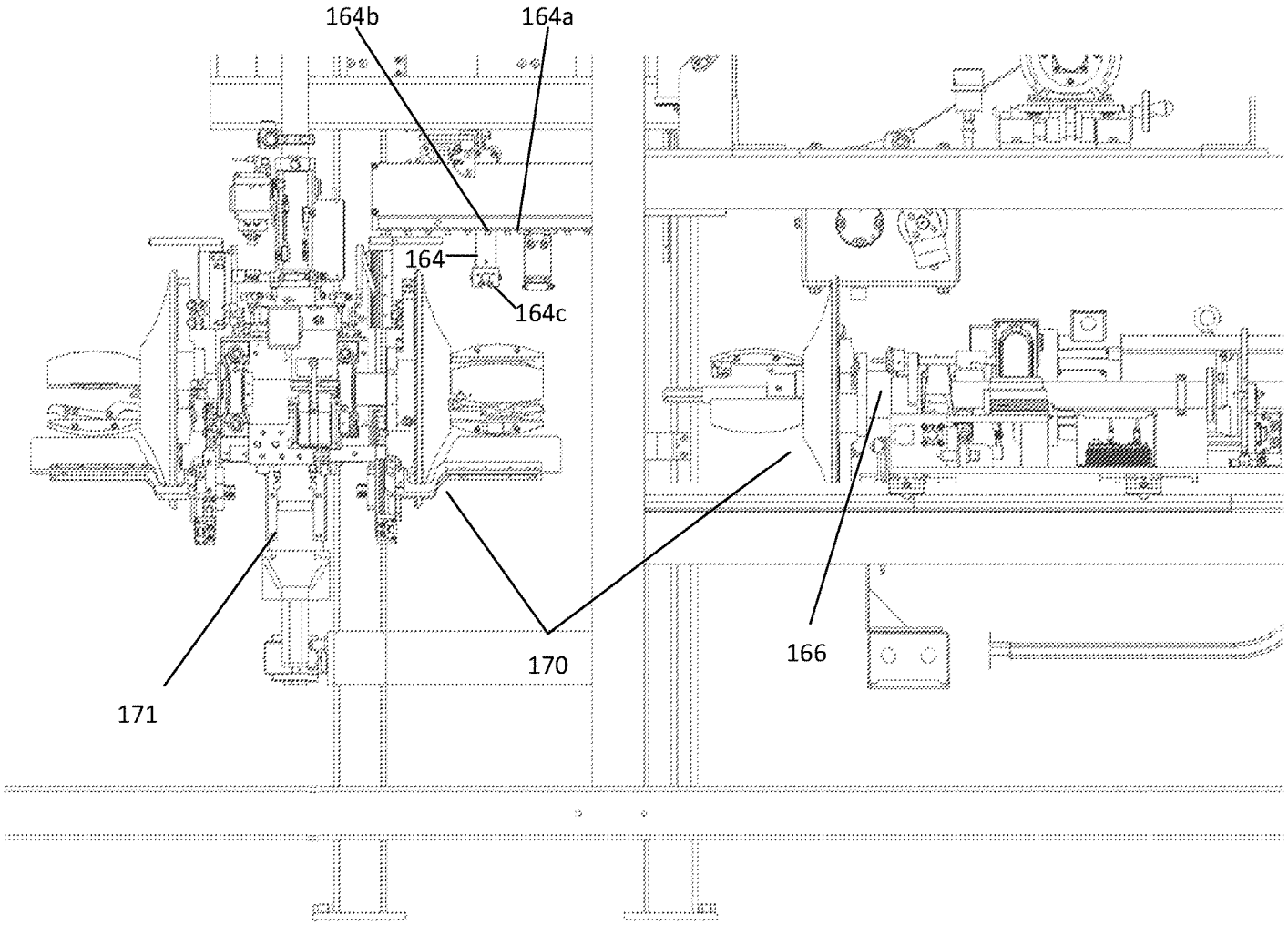
FIG. 2 is a perspective view of a traverse and portions of mandrels of FIG. 1A.

One embodiment of a take-up unit 116 is shown in FIGS. 1A and 2. The take-up unit 116 includes buffer 162 (FIG. 1A), a traverse 164 (FIG. 2), a motorized spindle 166 (FIGS. 1A and 2), and a set of mandrels 170 (FIGS. 1A, 2, 2A, and 2B), which are described in more detail with respect to FIGS. 2, 2A, and 2B.

Figure 2A:
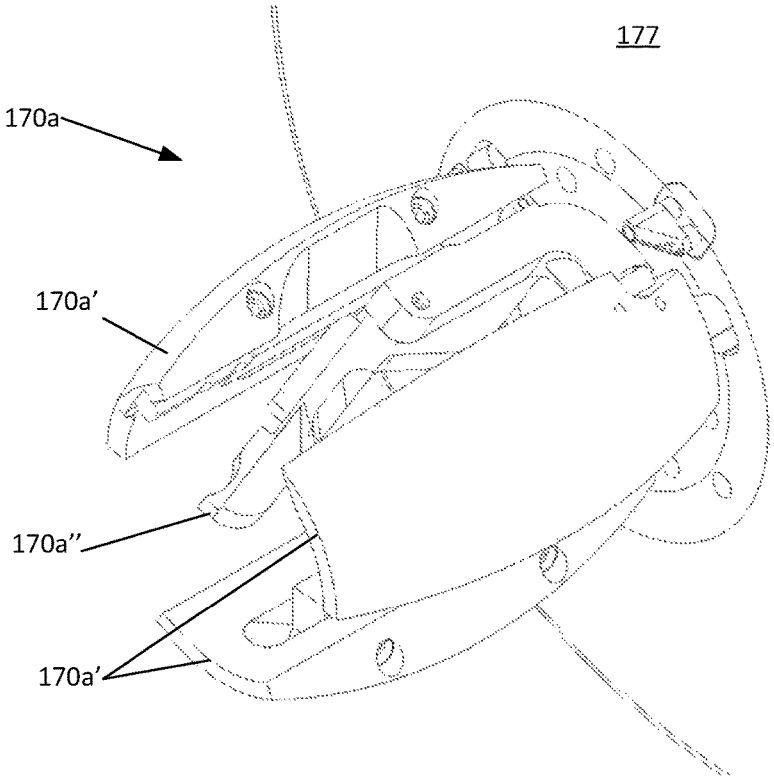
FIG. 2A is an illustration of an inner portion of a mandrel shown in FIG. 2 shown in a diametrically collapsed configuration.
Figure 2B:
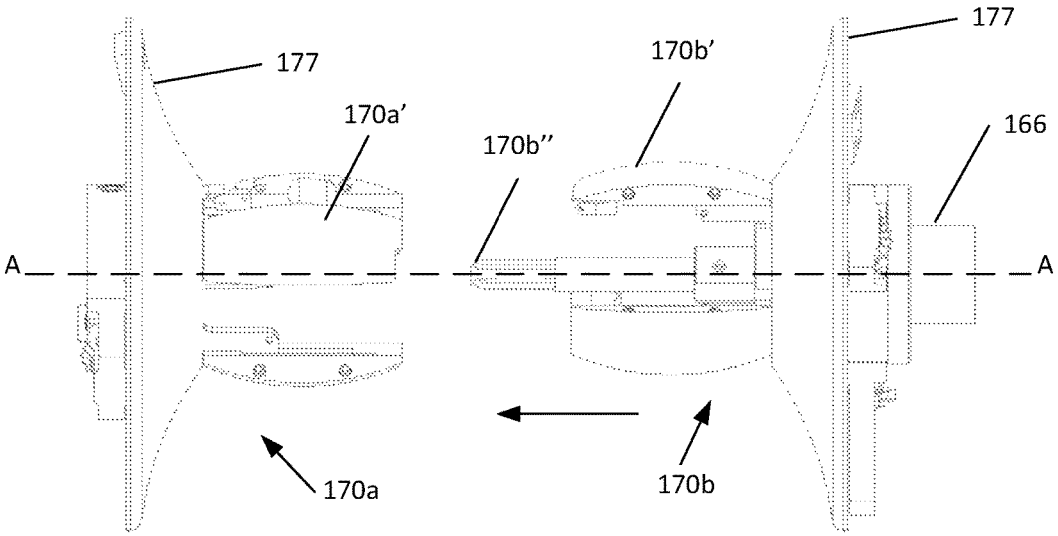
FIG. 2B is an illustration of a mating outer portion of the mandrel shown in FIG. 2A as it is approaching a mating position with the inner portion of the mandrel.

As will be described in greater detail below, the mandrels 170 are a two part assembly and the mandrel 170 shown in FIG. 2B is shown in an unassembled configuration. Inner mandrel 170 portions 170*a* are connected to a turret 171 about which the inner mandrel portions 170*a* can rotate in a horizontal plane to exchange places under the traverse 164, and each inner mandrel portion 170*a* can alternately mate with an outer (relative to turret 171) mandrel portion 170*b* to form a complete mandrel 170, as described in greater detail below. The traverse 164 is configured to move back and forth in a track in a beam 164*a* above the surface of the mandrel 170 as the mandrel spins on the spindle 166, thereby causing wire 110 to be directed onto the mandrel 170 in a desired pattern.

The traverse 164 is formed as a cantilevered beam 164*a* having a longitudinal slot (not shown) through which a guide tube 164*b* extends. Guide tube 164*b* terminates in a wire guide 164*c* which is located closest to the mandrel 170. The wire 110 is threaded through the guide tube 164*b* and exits the wire guide 164*c*. The guide tube 164*b* travels in (i.e., reciprocates in) the longitudinal slot of the beam 164*a* at desired speeds and along desired distances as controlled by the take-up system 116 as informed by the controller 118 in order to form the figure-eight pattern in a manner forming a payout hole extending radially out from the mandrel 170. The controller 118 is coupled to the take-up system 116 and can provide speed control information to direct the take-up system 116 to run at a desired rate. For example, the controller 118 may direct the take-up system 116 to cause the spindle 166 to run at a constant speed, or may cause the take-up system 116 to have the line speed be constant, thereby requiring the spindle speed to slow down over a period of time as the coil increases in diameter.

FIGS. 2A and 2B show further details of the construction of the mandrels 170, which are identical. Specifically, each mandrel 170 is a two-piece assembly comprised of a radially (relative to turret 171) inner portion 170*a* (FIGS. 2A and 2B) that is mounted to the turret 171 (FIG. 2) and a radially outer portion 170*b* (FIG. 2B) that operatively mates with the inner portion 170*a* to assemble the mandrel 170.

As shown best in FIG. 2A, the inner portion 170*a* of the mandrel 170 is comprised of a plurality of segments 170*a*' attached at their proximal ends to an endform 177. Each segment 170*a*' is shown with an outer surface that is bowed out (convex) in two directions. Each segment 170*a*' also has an inner surface that is concave in at least one direction. Each segment 170*a*' is arranged to move from a first collapsed position (as shown in FIG. 2A) where the segments 170*a*' are closer to a central axis A-A and to each other, to a second expanded or extended position shown in FIG. 2B where the segments 170*a*' are further away from the central axis and are circumferentially spaced further from each other. The segments 170*a*' have inner (relative to turret 171) ends that can slide radially in and out by operation of a chuck (in similar manner to the operation of a chuck on a lathe) to facilitate expansion and collapse of the segments 170*a*'. In the first collapsed position, the segments 170*a*' may touch each other or be very closely adjacent to each other. In the first collapsed position, the segments 170*a*' take the shape of a bumpy barrel. In the second expanded or extended position seen in FIG. 2A, the segments 170*a*' are circumferentially spaced from one another and their outer surfaces appear at any cross-section to define a circle, although again, the circle may be slightly bumpy. In one embodiment, the inner portion 170*a* is configured such that once the segments 170*a*' are diametrically positioned, further movement of the segments 170*a* can only occur by the application of force to the chuck. Alternatively, in one embodiment a lock may be provided to keep the segments 170*a*' in the expanded position and/or in the collapsed position.

One of the mandrel segments 170*a*' includes a clamp 170*a*" for clamping the wire 110 and retaining it with the mandrel 170 prior to winding. Specifically, the clamp 170*a*" may have a pivoting arm to operatively grab the wire. The pivoting arm of the clamp 170*a*" may have a curved notch (as shown in FIG. 2A) or other retaining feature (e.g., teeth) at its distal end for gripping the wire when the pivoting arm is closed. The clamp 170*a*" may be configured to clamp the wire as the segments 170*a*' move from the collapsed configuration further apart into the expanded configuration. When the segments 170*a*' are in the expanded configuration, the clamp 170*a*" holds the wire firmly.

Figure 4:
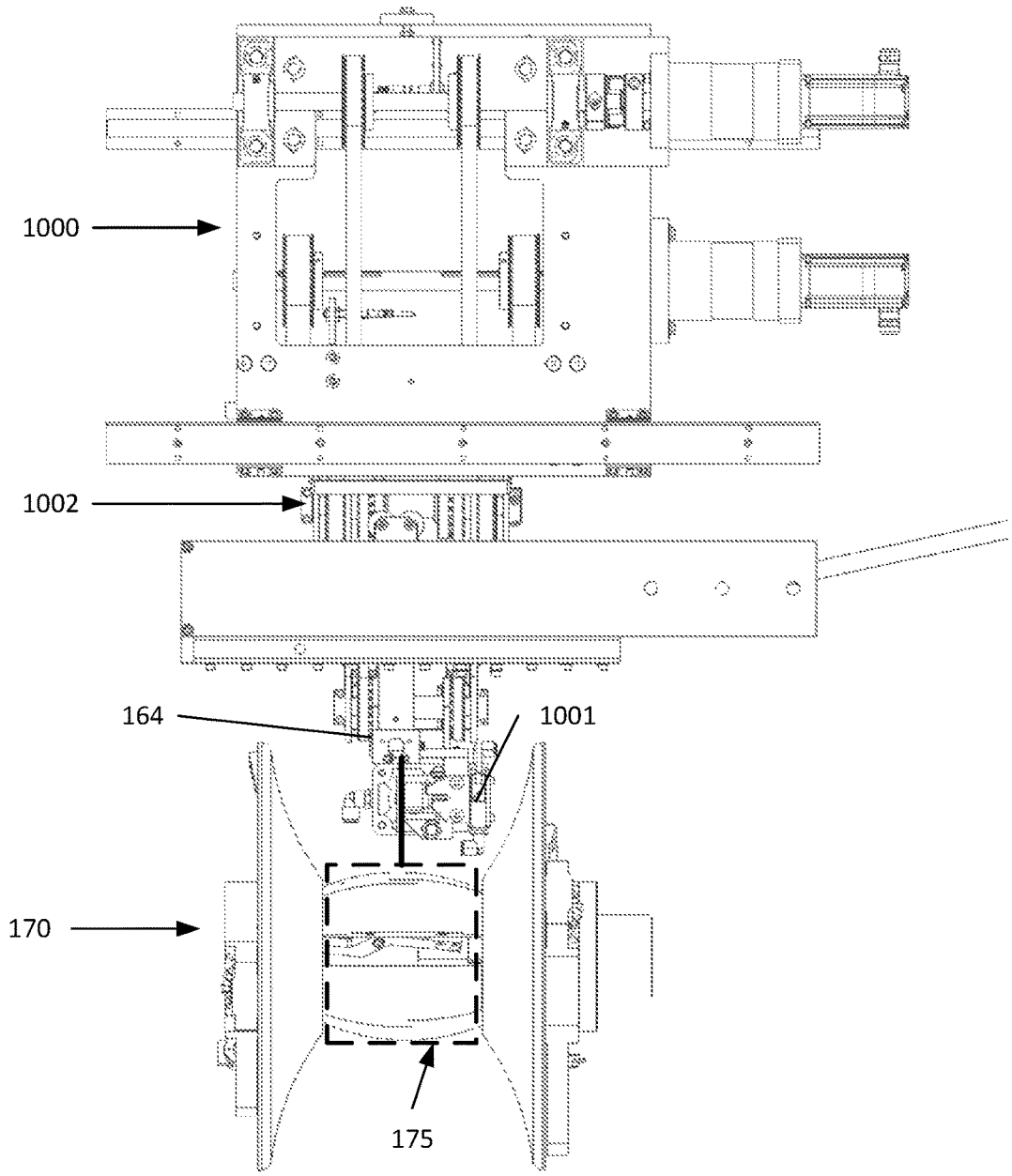
FIG. 4 shows a wound coil on a mandrel with the cutter/grabber in a wait-to-cut position.

The outer portion 170*b* of the mandrel 170 has segments 170*b*' similar to the segments 170*a*' of the inner portion 170*a*. However, unlike segments 170*a*', the outer portion 170*b* does not have a clamp like clamp 170*a*". Also, a central shaft 170*b*" extends axially through the outer portion 170*b*. The shaft 170*b*" aids in locating and aligning the inner and outer portions 170*a* and 170*b* during assembly of the mandrel 170. Also, the shaft 170*b*" transmits torque from a drive spindle 166 coupled to the shaft 170*b*" (and the outer portion 170*b*) to the inner portion 170*a* of the mandrel 170 when the mandrel 170 is rotated during winding. The inner and outer portions 170*a* and 170*b* are configured to mate together as shown in FIG. 2B when the outer portion 170*b* is moved axially into the first portion along axis A-A in FIG. 2B in the manner shown by the arrow. The mandrel segments 170*b*' of the outer portion 170*b* are inserted between the mandrel segments 170*a*' of the inner portion 170*a* and the distal ends of each portion 170*a* and 170*b* couple with the endforms 177 of the other portion so that the mandrel 170 forms a complete assembly, as shown in FIG. 4, for example.

In the embodiment of FIGS. 2A and 2B, the endforms 177 are shaped substantially as cymbals and are disposed on the mandrel 170 such that they are faced away from each other. The portions 170*a* and 170*b* of the mandrel may be separated from each other by collapsing the segments 170*b*' and moving the outer portion 170*b* outwardly along axis A-A so that a coil of wire on the mandrel 170 may be retained on segments 170*a*' of inner portion 170*a* after a winding is completed, as will be described in greater detail below.

Figure 2C:
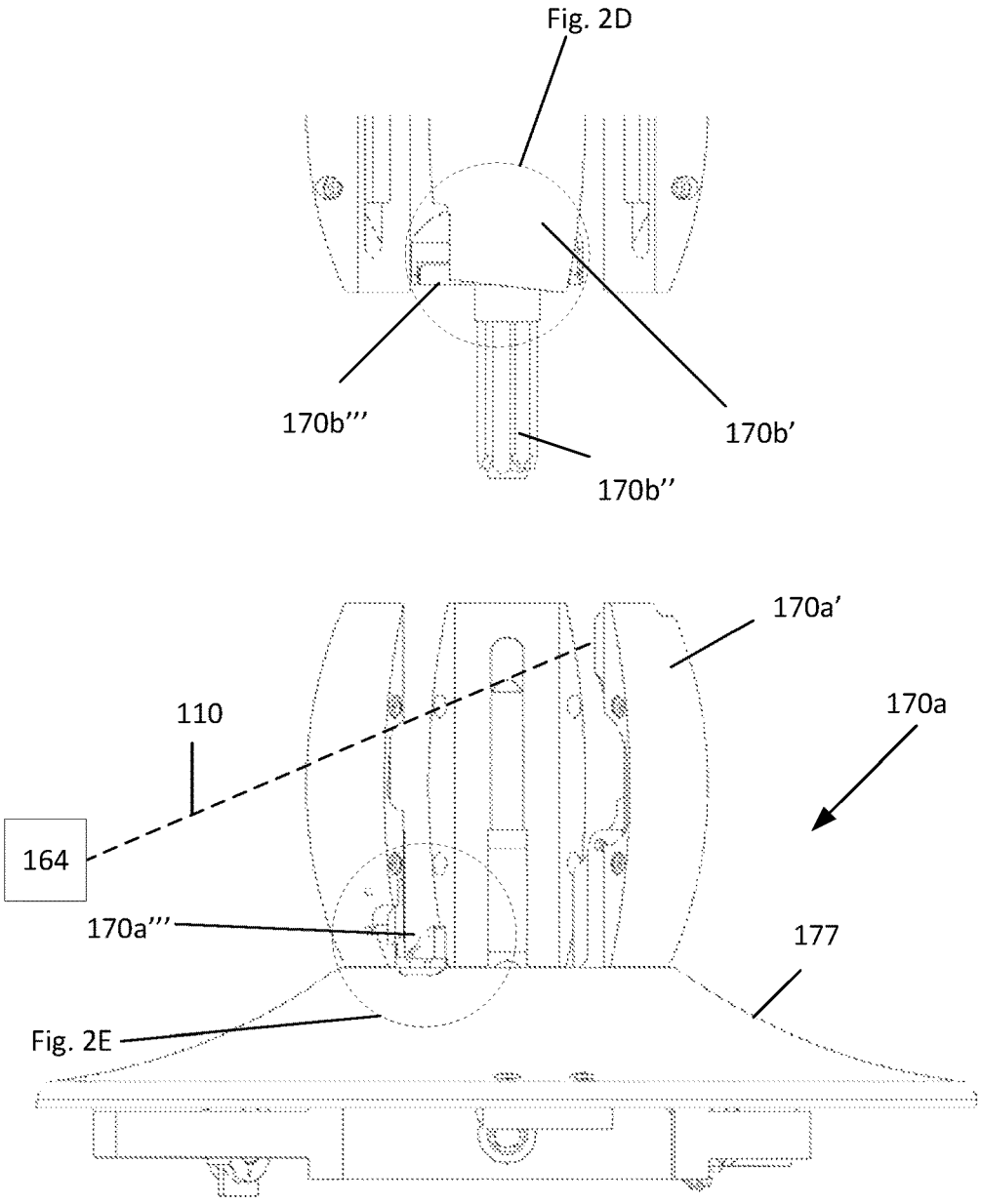
FIG. 2C shows a top view of the arrangement shown in FIG. 2B.
Figure 2D:
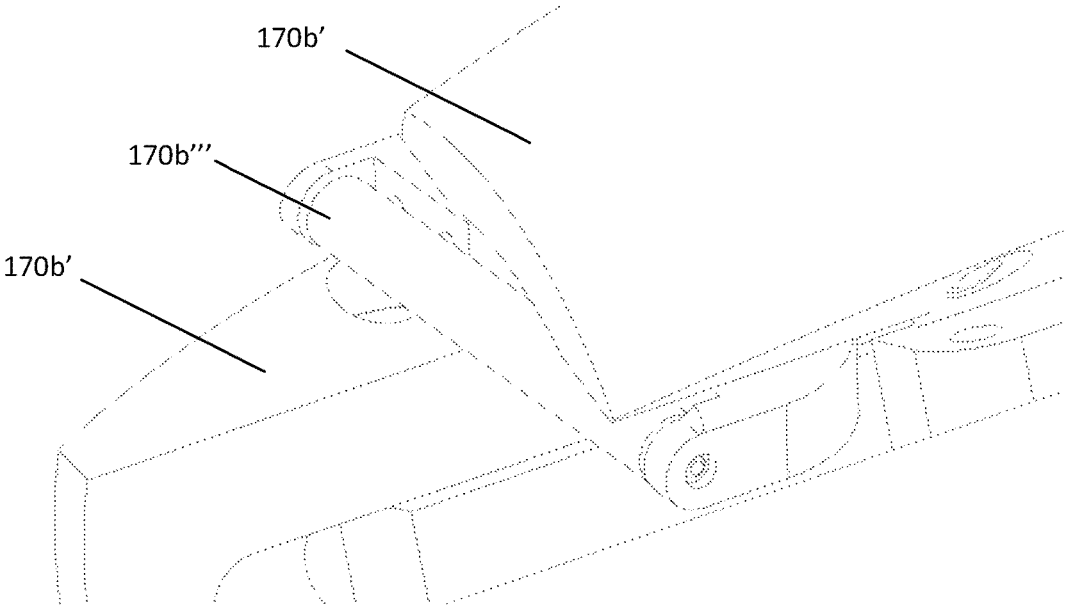
FIG. 2*d* is a detailed view of a portion of the outer portion of the mandrel shown in FIG. 2C.

FIG. 2C illustrates other details of the inner and outer portions 170*a* and 170*b* of the mandrel. For example, the outer portion 170*b* includes a roller 170*b*'" connected to one of the segments 170*b*'. The roller 170*b*'" is configured to engage and guide a portion of wire 110 as the outer portion 170*b* mates with the inner portion 170*a*, described in greater detail hereinbelow. FIG. 2D shows a detailed view of the portion of segment 170*b*' shown in FIG. 2C and, particularly, shows greater detail of the roller 170*b*" attached to that segment 170*b*'.

Figure 2E:
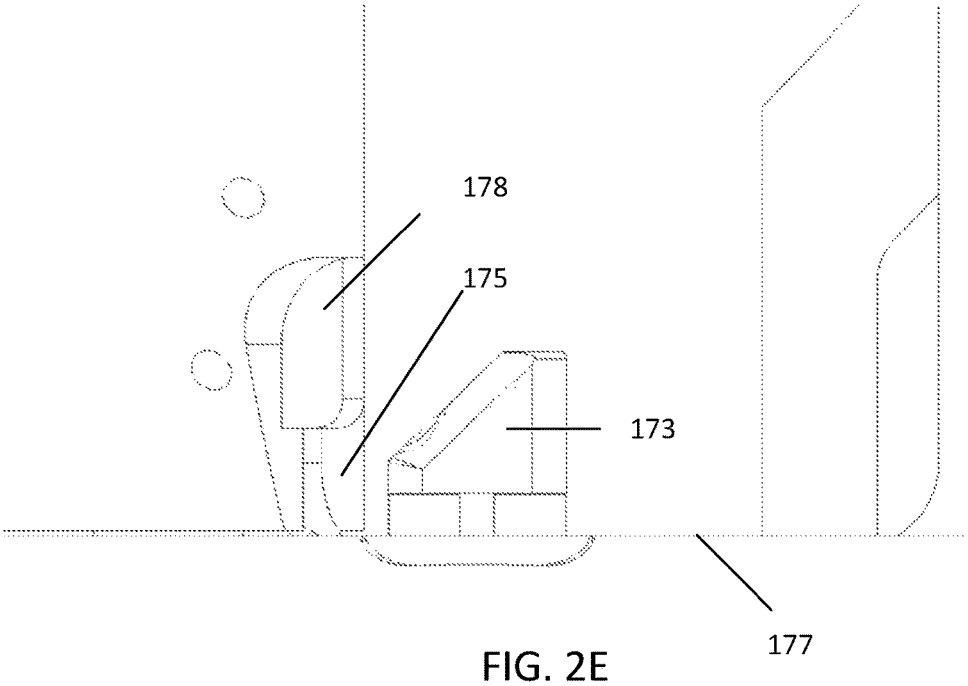
FIG. 2E is a detailed view of a portion of the inner portion of the mandrel shown in FIG. 2C.

Also, FIG. 2C illustrates a spring loaded latch mechanism 170*a*'", which is shown in greater detail in FIG. 2E. The latch mechanism 170*a*'" includes a spring loaded latch 173 that may be mounted on the endform 177 for movement parallel to axis A-A. One of the segments 170*a*' of the inner portion 170*a* of the mandrel 170 adjacent to the latch 173 defines a notch 175 that is partially occluded by a flexible flap 178. The latch 173 is configured to move between a first, blocking position (shown in FIG. 2E) and a second, unblocking position in which the latch 173 moves toward the endform 177 (e.g., down ward in FIG. 2E). In the blocking position, a space between the latch 173 and the surface of the segment 170*a*' of the notch 175 and/or the flap 178 is less than a diameter of the wire 110 so that when wire is in the notch 175 it will be retained until the wire 110 applies sufficient pressure to flap 178 to cause the flap 178 to yield and allow the wire 110 to exit the notch 175.

In winding a figure-eight coil of wire, a beginning end of the wire 110 is captured by the mandrel 170, and the mandrel is spun by the spindle 166 as the traverse 164 reciprocates and guides the wire onto the mandrel in a figure-eight pattern with a payout hole. The function of the traverse 164, payout unit 112, a dancer/accumulator (tensioner) 114, and a controller 118 may be the same as those described in U.S. patent application Ser. No. 14/740,571 (Kotzur et al.), the entire contents of which are incorporated herein by reference. When winding is completed, the wire is cut, the portions 170*a* and 170*b* of the mandrel 170 separate as described above, and the turret 171 rotates to switch the positions of the inner portions 170*a* so that the empty mandrel portion 170*a* is under the traverse 164, where it is readied for winding another coil, and the full mandrel portion 170*a* (holding the wound coil) is over an unloading area 180 (FIG. 1A). In the unloading area 180, the wound coil can be removed from the inner portion 170*a* of the mandrel 170 for packaging.

Figure 3:
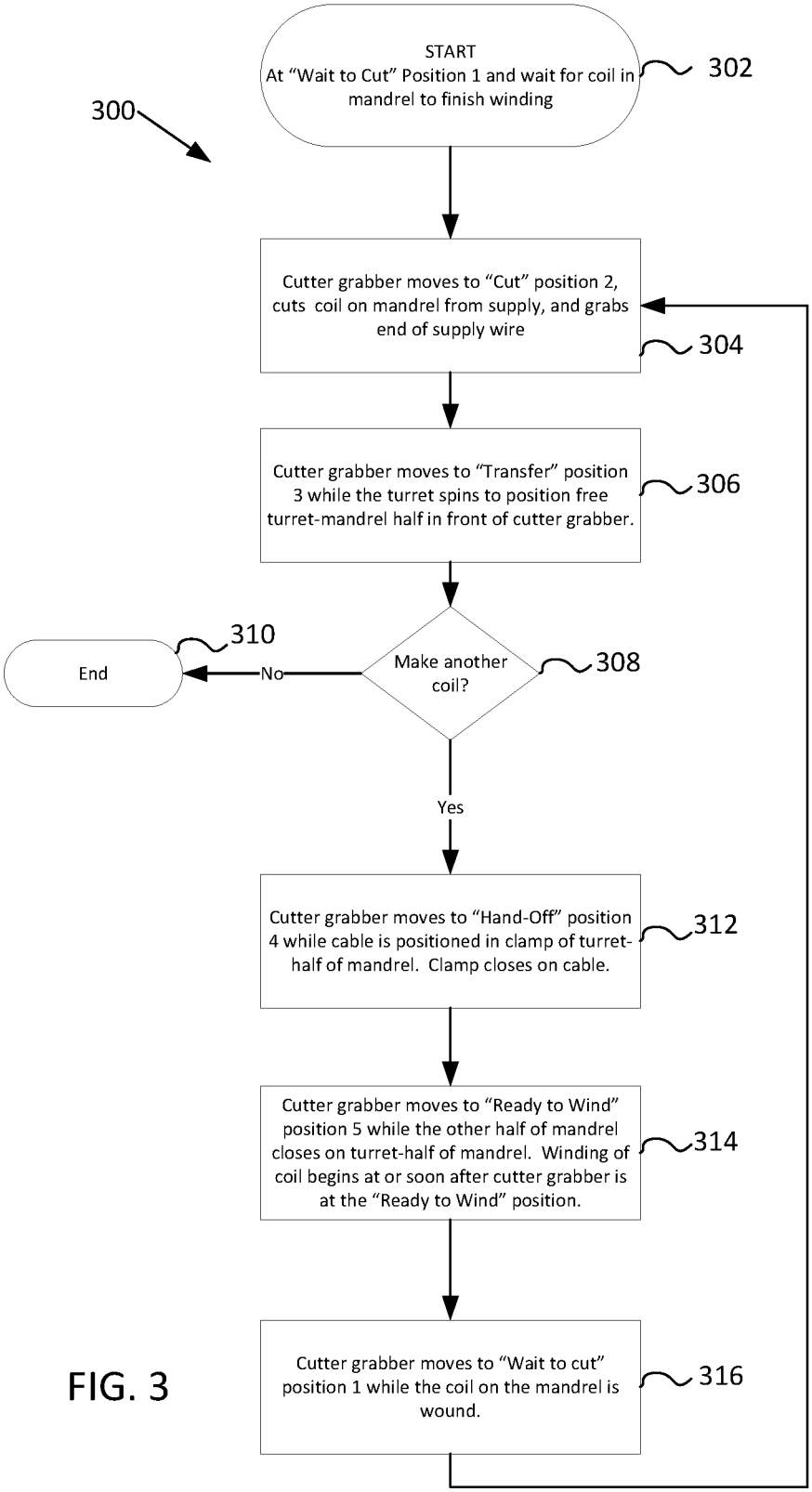
FIG. 3 is an example workflow of a cutting and grabbing process.

The following describes the processing steps of a resetting process that occurs between winding of coils on the machine 116 (e.g., between the end of winding a first coil and the beginning of winding a second coil). In that regard, FIGS. 3 and 3A relate to such processing steps and illustrate a workflow of the resetting process that preferably employs a cutter/grabber 1001 described herein with respect to FIGS. 10A to 13. During the workflow, the cutter/grabber 1001 moves through a plurality of different positions in a route or path 350 shown in FIG. 3A. At the beginning of the workflow, at 302, the distal end of the cutter/grabber 1001 is located at a first, "wait-to-cut" position 350*a*. The cutter/grabber waits at the wait-to-cut position while the coil finishes winding. When the coil is fully wound, at 304, the cutter/grabber 1001 moves from the wait-to-cut position to a second, "cut" position 350*b*, where the cutter/grabber 1001 cuts the wire of the coil from the supply wire fed from the traverse 164 and grabs the free, cut end of the supply wire from the traverse 164. To permit clearance for the turret 171 to rotate the mandrels 170, at 306, the cutter/grabber 1001 moves from the cut position to a third, "transfer" position 350*c* while the turret 171 rotates to position the empty inner mandrel portion 170*a* under the traverse 164 and in front of the cutter/grabber 1001. At 308 it is determined whether or not to make another coil. If it is determined that no more coils are to be made (No at 308), then the workflow ends at 310. However, if it is determined that another coil is to be made (Yes at 308), then the workflow proceeds to 312. At 312 the cutter/grabber 1001 moves from the transfer position 350*c* to a fourth, "hand-off" position 350*d* where the wire 110 is drawn from the traverse 164.

As the cutter/grabber 1001 is moved to the hand-off position (or possibly after the cutter/grabber is already in the hand-off position), the traverse 164 may move in a direction along beam 164*a* so that the wire extends through the grabber 170*a*" of the inner portion 170*a* of the mandrel 170. The grabber 170*a*" clamps down on the wire to retain it and the cutter/grabber 1001 releases the end of the wire, thus completing a hand-off of the wire from the cutter/grabber 1001 to the inner portion 170*a* of the mandrel 170. As the cutter/grabber 1001 moves through a series of positions between the cut position 350*b* and the hand-off position 350*d*, a length of wire between the traverse 164 and the free end of the wire does not decrease, and the length of wire between the traverse 164 and the free end of the wire is longer at the hand-off position 350*d* than at the cut position 350*b*. The length of wire between the traverse 164 and the end of the wire when the cutter/grabber 1001 is at the hand-off position may be about eighteen inches. In other words, as the cutter/grabber 1001 moves through a series of positions between the cut position 350*b* and the hand-off position 350*d*, the wire does not retract relative to the traverse 164, and, thus, there is no need to reverse the direction of the buffer 162 (FIGS. 1 and 1A) during the resetting process.

At 314, the cutter/grabber 1001 moves downward to a fifth, "ready-to-wind" position 350*e* while the inner portion 170*a* of the mandrel 170 moves up into position coaxial with the outer portion 170*b* of the mandrel 170. The outer portion 170*b* of the mandrel 170 moves axially (radially inward relative to turret 171) into mating position with the inner portion 170*a* of the mandrel 170 in the direction shown in FIG. 2B to fully assemble the mandrel 170, so that the assembled mandrel 170 is ready to wind another coil. At 316 the mandrel 170 may begin spinning to wind another coil while the cutter/grabber 1001 moves from the ready-to-wind position 350*e* back to the wait-to-cut position 350*a*. Thereafter, the workflow proceeds to 304 and repeats or ends as described above.

It is preferable that the cutter/grabber 1001 moves as quickly as possible throughout the path 350 in order to reduce the reset time between the end of winding one coil and beginning winding of another coil. Thus, for example, it is preferable to lower the cutter/grabber 1001 downward quickly from the hand-off position 350*d* to the ready-to-wind position 350*e* so that the cutter/grabber 1001 is out of the way of the mandrel 170 so that the winding process can begin quickly after the hand-off of the wire to the mandrel 170 is complete.

In contrast to the aforementioned D2000 machine of the prior art, the cutter/grabber 1001 is supported from above by a positioning system 1000 (shown for example in FIG. 4), rather than from below. The positioning system 1000 does not interfere with the assembly of the mandrel 170, thereby decreasing the reset time between winding coils and increasing throughput of the machine 116. The positioning system 1000 location relative to the cutter/grabber 1001 may be based on the geometry of the take-up unit 116, and, more specifically, the geometry of the mandrel portions 170*a* and 170*b* and the traverse 164. Thus, based on the geometry of the mandrel portions 170*a* and 170*b* and the traverse 164 in the take-up unit 116 described herein, locating the positioning system 1000 above the cutter/grabber 1001 locates the positioning system 1000 and cutter/grabber 1001 so that they do not interfere with any movement of the mandrels 170 (and any coil thereon) between the cut position 350*b* and the hand-off position 350*d*. While the cutter/grabber 1001 and/or positioning system 1000 may occupy the space between the mandrel 170 and the traverse 164 during the cut operation and hand-off, the distance and time required to move the cutter/grabber 1001 and/or positioning system 1000 out of interference with the mandrel 170 and the traverse after those operations (i.e., from the cut position 350*b* to the transfer position 350*c*, and from the hand-off position 350*d* to the ready-to-wind position 350*e*) can be minimized.

Figure 3A:
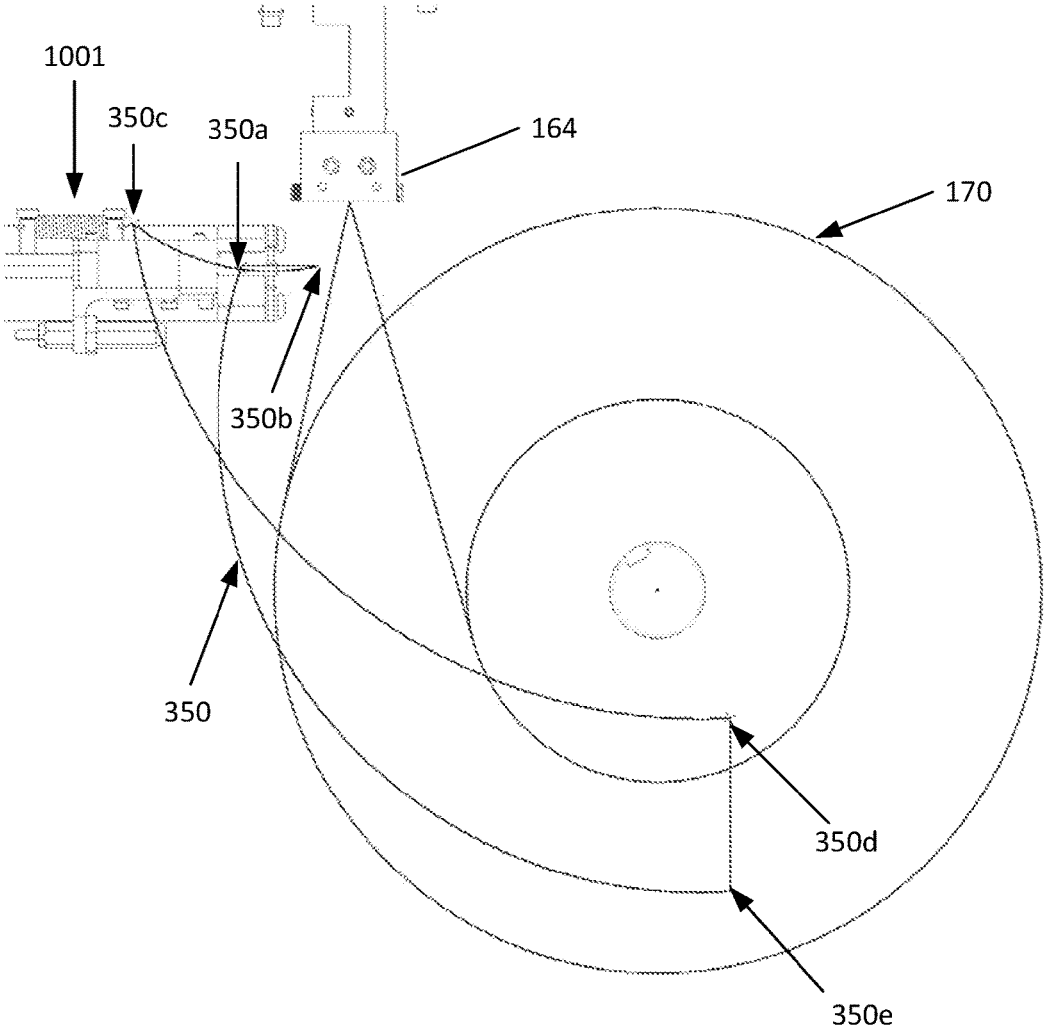
FIG. 3A is a schematic illustration showing a path of the cutter/grabber as it moves during the workflow of FIG. 3.

It is noted that FIG. 3A shows a two-dimensional view of the pathway 350. However, it will be appreciated that the movement of the cutter/grabber 1001 along the path 350 may be in three dimensions. Also, while the positions described in the workflow 300 have been described as positions of the cutter/grabber 1001, it is noted that the traverse 164 can move along beam 164*a* during the workflow 300 and also have distinct positions along its longitudinal travel path associated with each position of the cutter/grabber 1001 noted in the workflow 300. Such relative movement between the cutter/grabber 1001 and the traverse 164 will be described below with reference to FIGS. 4 to 8B.

Figure 4A:
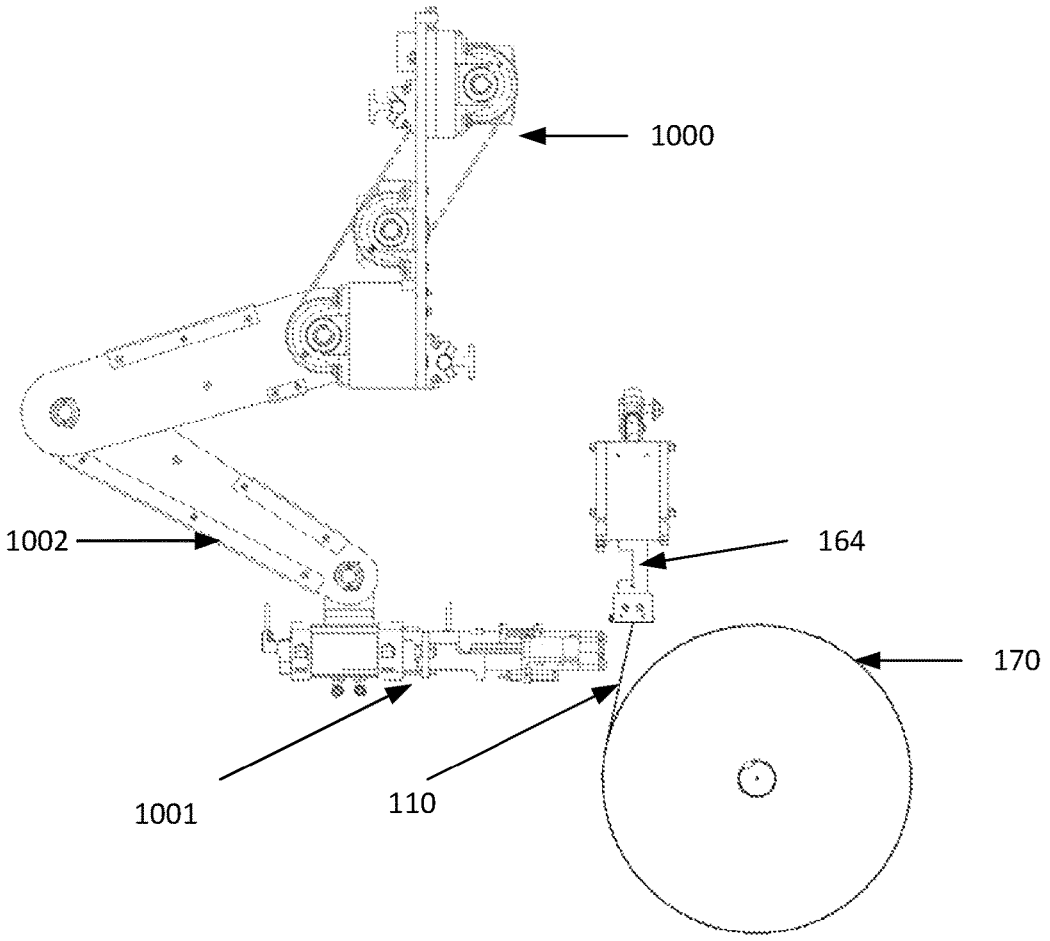
FIG. 4A shows a view transverse to the view of FIG. 4 of the cutter/grabber in the wait-to-cut position.

FIG. 4 shows a front view of a coil 175 on mandrel 170 and the cutter/grabber 1001 in the wait-to-cut position 350*a*. The cutter/grabber 1001 is behind and to the right of the traverse 164 in FIG. 4. FIG. 4A is a side view and shows the position of the cutter/grabber 1001 relative to the traverse 164 and the mandrel 170 when the cutter/grabber 1001 is in the wait-to-cut position 350*a*. As shown in FIG. 4A, the cutter/grabber 1001 is coupled to and positioned by a multi jointed arm 1002, which is part of a positioning system 1000, further details of which are provided below. In the wait-to-cut position 350*a*, the cutter/grabber 1001 may be within about 6 inches, and preferably within three inches, of the traverse 164 to minimize the time of movement of the cutter/grabber 1001 between the wait-to-cut position 350*a* and the cut position 350*b*.

Figure 5:
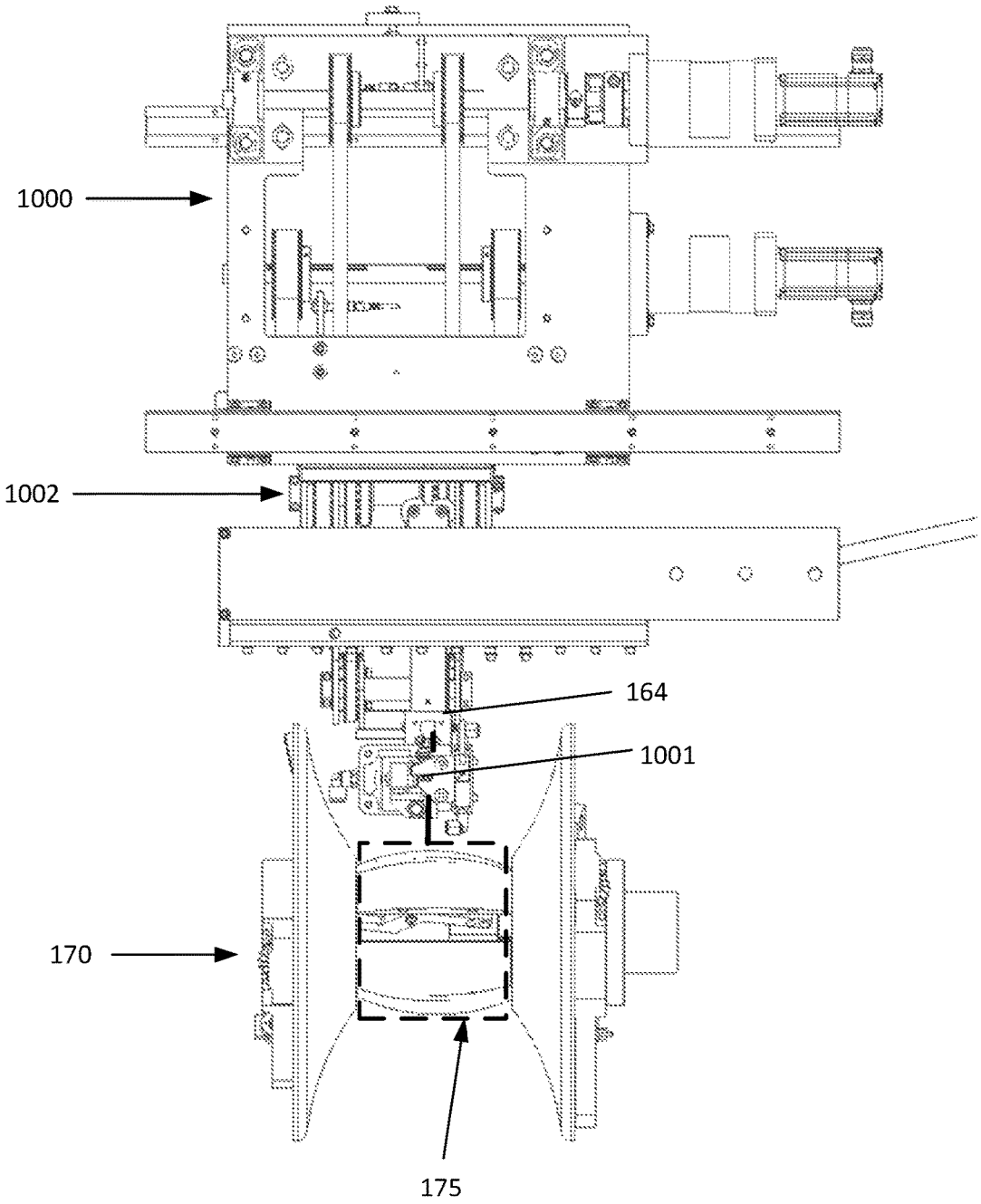
FIG. 5 shows the cutter/grabber in a cut position.
Figure 5A:
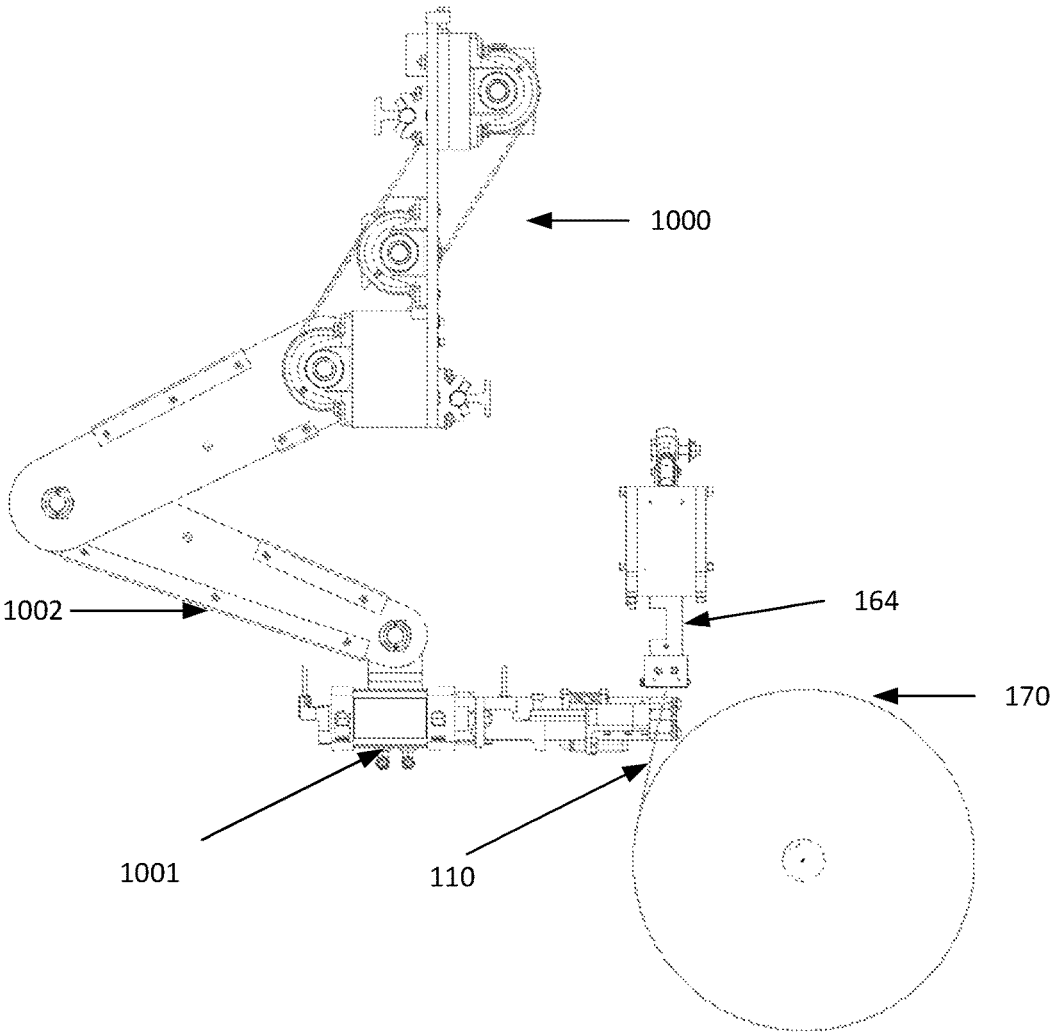
FIG. 5A shows a view transverse to the view of FIG. 5 of the cutter/grabber in the cut position.
Figure 6:
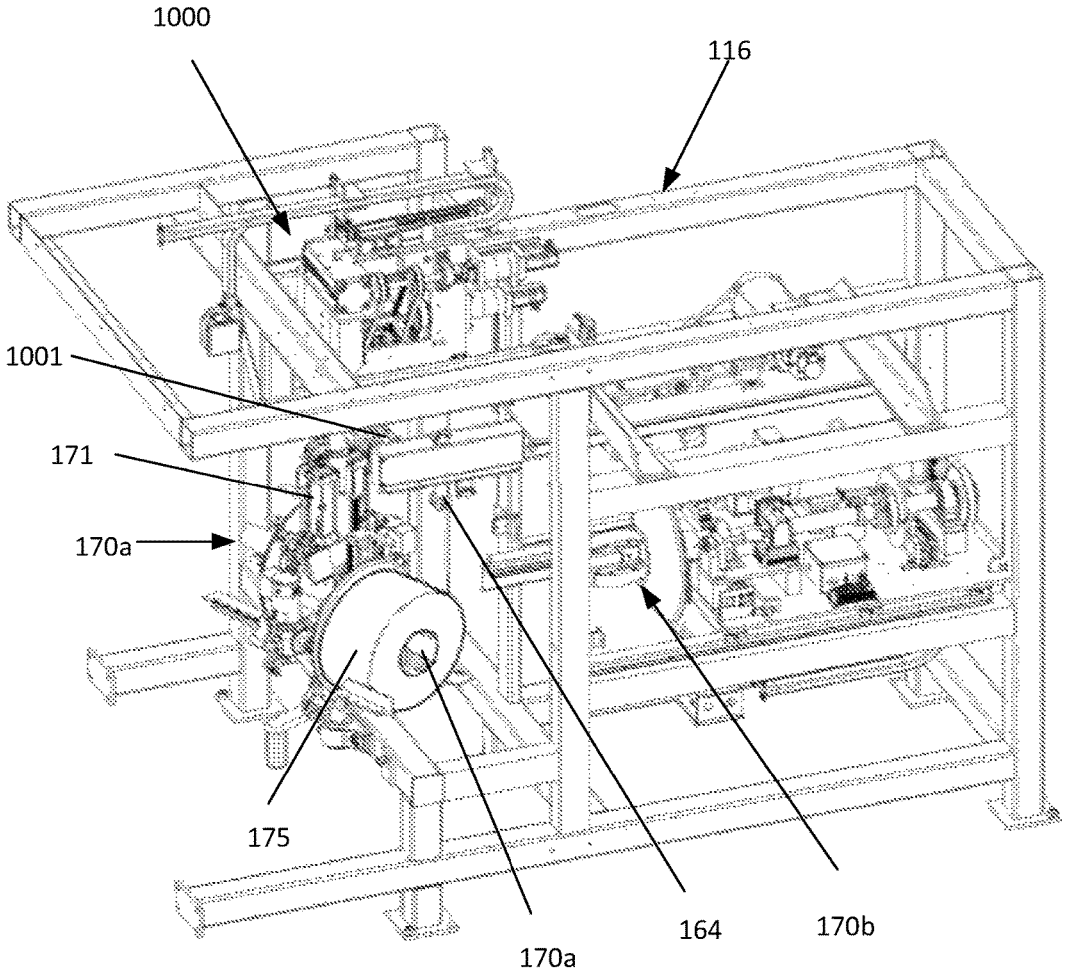
FIG. 6 illustrates the turret rotating to switch mandrel positions, transfer the cut coil, and the cutter/grabber moved to a transfer position.
Figure 7:
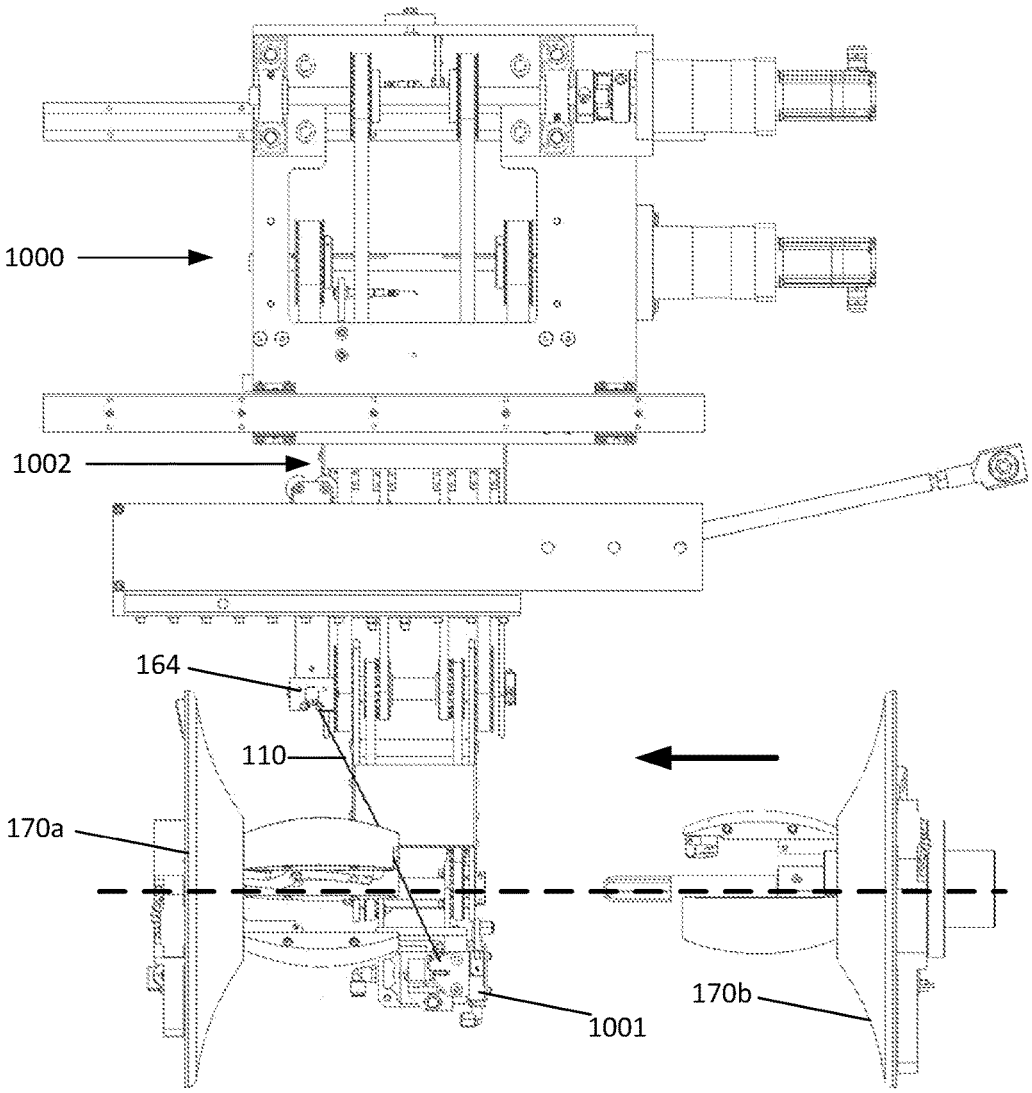
FIG. 7 shows the cutter/grabber in a hand-off position.
Figure 7A:
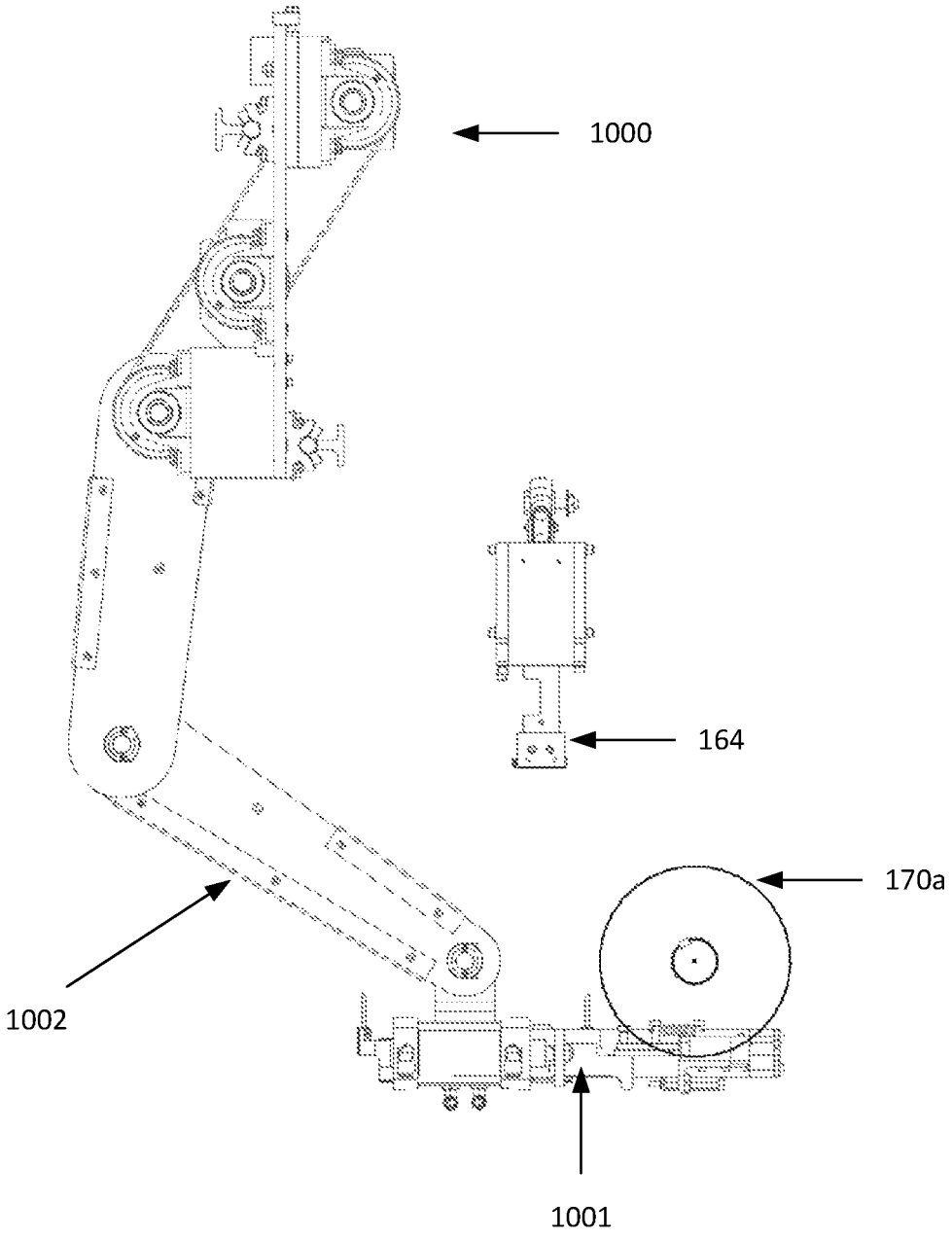
FIG. 7A shows a view transverse to the view of FIG. 7 of the cutter/grabber in the hand-off position.
Figure 8:
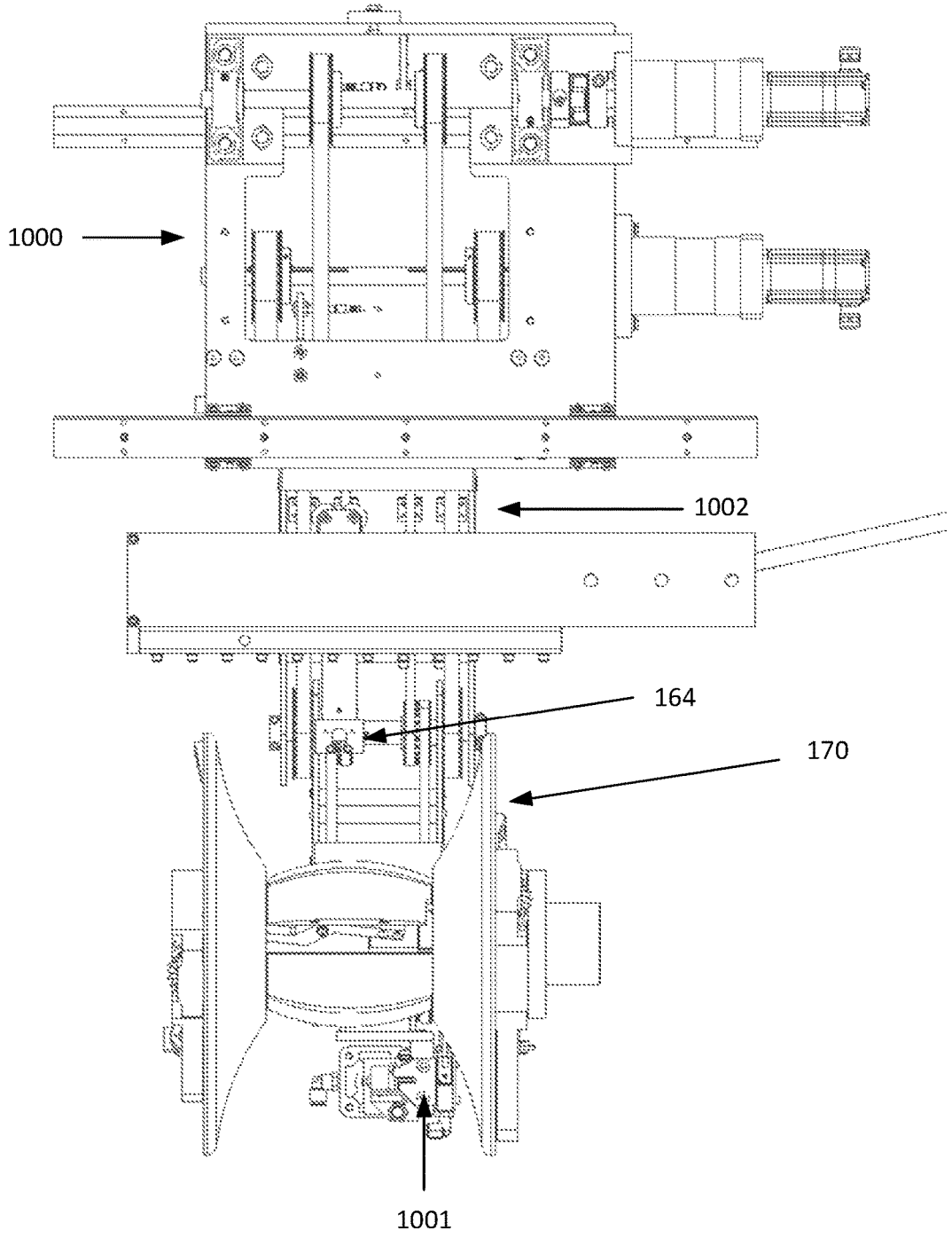
FIG. 8 shows the mandrel in a fully mated configuration with the mandrel portions in their respective expanded configuration and with the cutter/grabber in a ready-to-wind position.
Figure 8A:
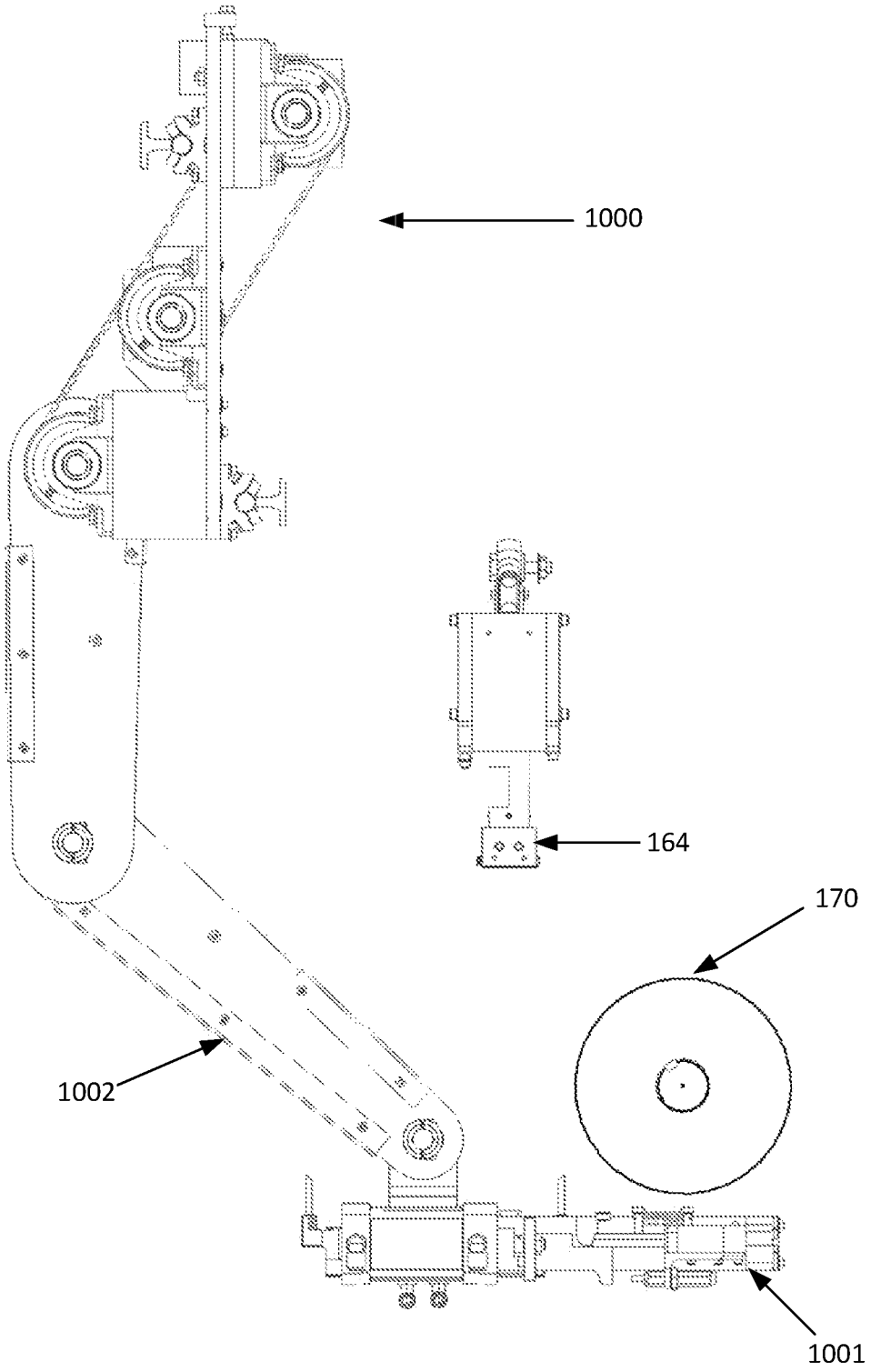
FIG. 8A shows a view transverse to the view of FIG. 8 of the cutter/grabber in the ready-to-wind position.
Figure 8B:
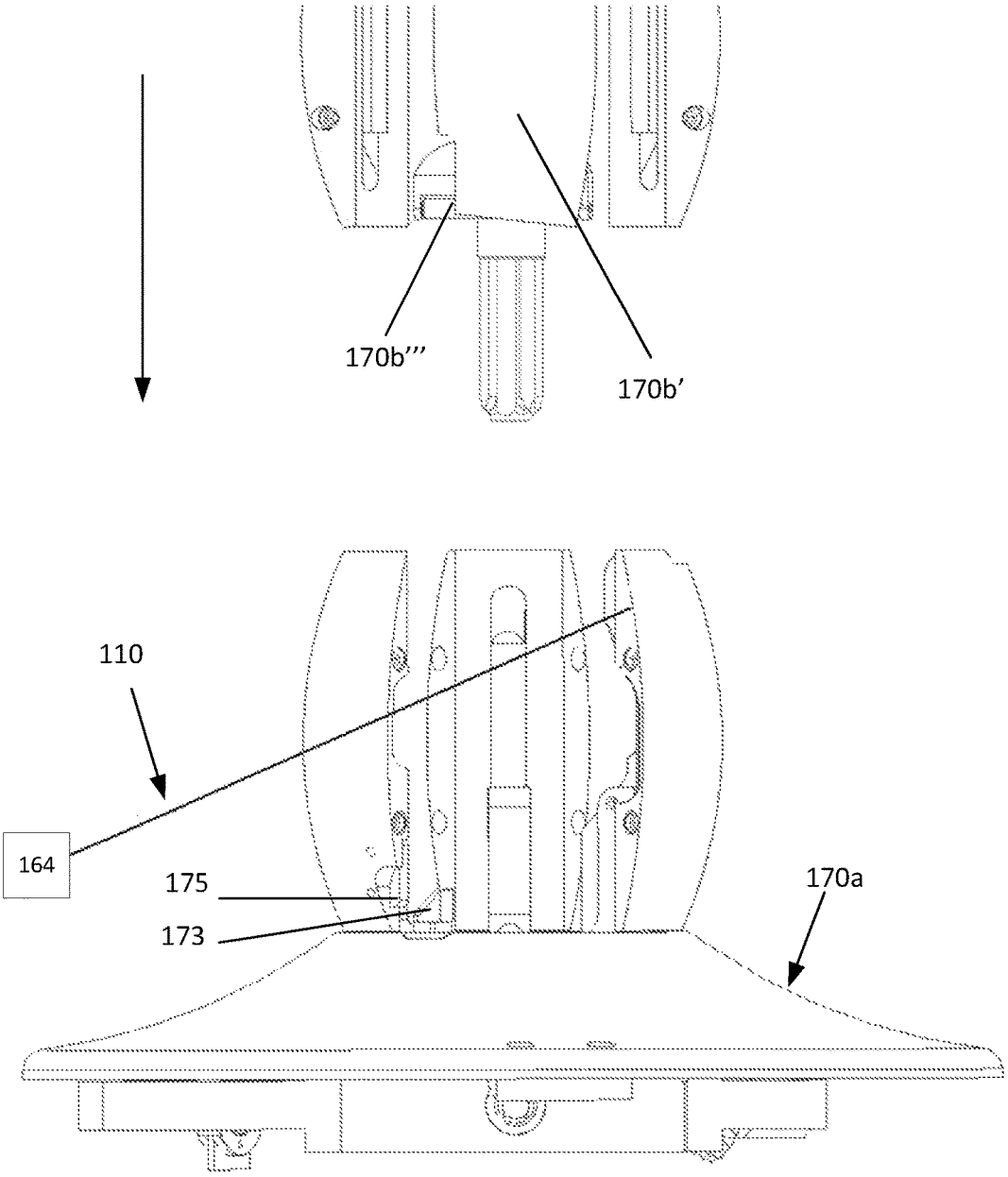
FIGS. 8B to 8D show top views of the positions of the mandrel portions of FIG. 8, as a progression, between the hand-off position and the ready-to-wind position.
Figure 8C:
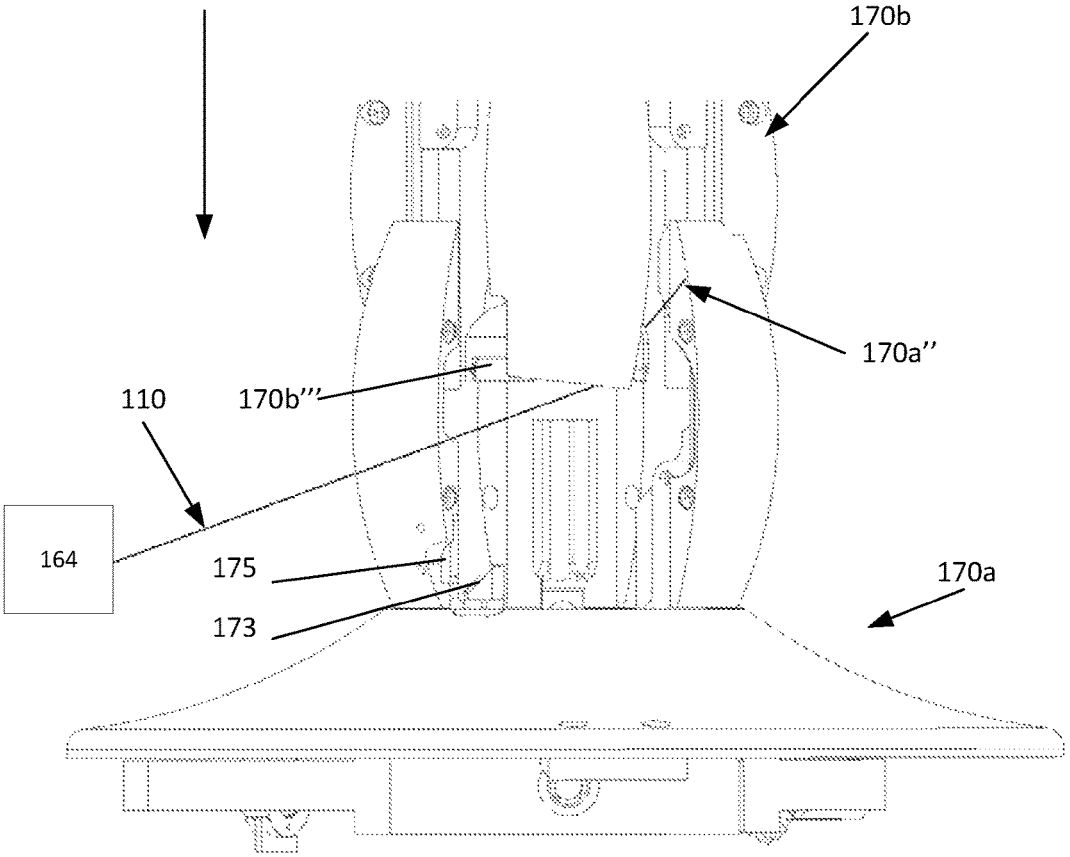
Figure 8D:
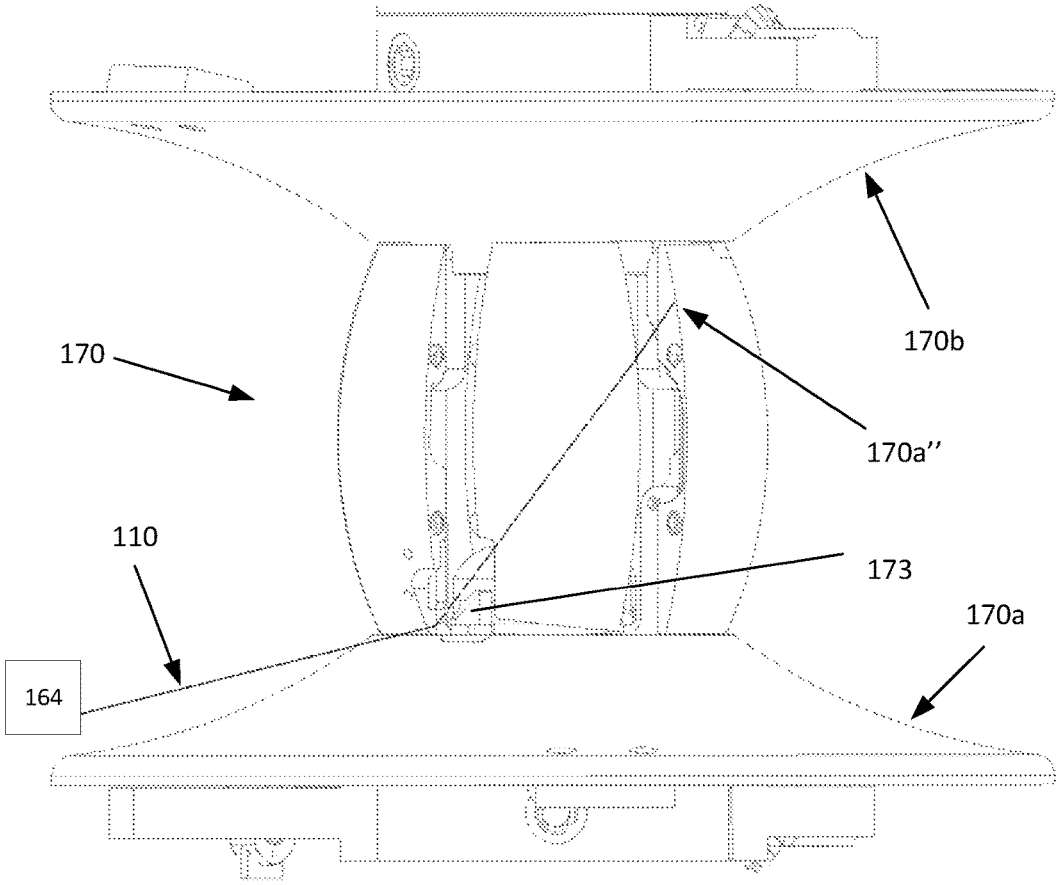

FIGS. 5 and 5A show the cutter/grabber 1001 in the cut position 350*b*. While the arm 1002 moves the cutter/grabber 1001 from the wait-to-cut position 350*a* to the cut position 350*b*, the traverse 164 may or may not move. Once the wire 110 is cut in the cut position 350*b*, the cutter/grabber 1001 cuts the wire 110 and grabs the free end of the wire 110 extending from the traverse 164, and the arm 1002 moves the cutter/grabber 1001 into the transfer position 350*c* (into the page in FIG. 6), while the mandrel portions 170*a* and 170*b* of the mandrel 170 under the traverse 164 are separated to permit the turret 171 to rotate, as shown in FIG. 6. The rotation of the turret 171 happens quickly, e.g., within two seconds, and preferably within one second or less. The rotation of the turret 171 switches the positions of the two inner portions 170*a* of the mandrels 170 so that the free inner portion 170*a* portion is moved into position under the traverse 164 as shown in FIG. 7 and the inner portion 170*a* holding the coil is moved into position in the coil unloading area 180 (FIG. 1A). Once the inner portion 170*a* is under the traverse 164, the arm 1002 moves the cutter/grabber 1001 to the hand-off position 350*d* and the traverse 164 moves to the left in FIG. 7 to position the wire 110 through the grabber 170*a*" of the inner portion 170*a*. Once the grabber 170*a*" of the inner portion 170*a* grabs the wire 110, the hand-off is complete, allowing the arm 1002 to release the end of the wire 110 and move the cutter/grabber 1001 downward to the ready-to-wind position 350*e*, while the outer portion 170*b* of the mandrel 170 mates with the inner portion 170*a* of the mandrel 170, as shown in FIGS. 8 and 8A. Between the hand-off position 350*d* and the ready-to-wind position 350*e* of the cutter/grabber 1001, the traverse 164 moves to a "spindle track" position (FIG. 8B), which locates the wire 110 so that it can be guided by the roller 170*b*'" (FIGS. 2C, 2D) of the outer portion 170*b* of the mandrel 170 as the outer portion 170*b* moves into mating position with the inner portion 170*a* (i.e., in the direction of the arrow in FIG. 8B). Specifically, as shown in FIG. 8C, as the roller 170*b*' engages the wire 110 between the gripper 170*a*" and the traverse 164, the roller 170*b*'" guides a portion of the wire 110 toward the notch 175 of the inner portion 170*a*. As shown in FIG. 8D, when the inner and outer portions 170*a* and 170*b* of the mandrel 170 are mated together, the wire 110 is pushed into the notch 175 and is retained in the notch 175 by the roller 170*b*', the latch 173, and the flap 178. The length of wire between the clamp 170*a*" and the latch 173 may be used during a packaging procedure.

Also, as shown in FIGS. 8 and 8A, the cutter/grabber 1001 is positioned below the mandrel 170 so that the cutter/grabber 1001 cannot interfere with rotation of the mandrel 170. Thus, the winding process can begin even while the cutter/grabber 1001 is not at the wait-to-cut position 350*a*. Accordingly, while the arm 1002 returns the cutter/grabber 1001 from the ready-to-wind position 350*e* to the wait-to-cut position 350*a*, the mandrel can wind coil, further reducing the reset time and increasing throughput of coils.

Figure 9:
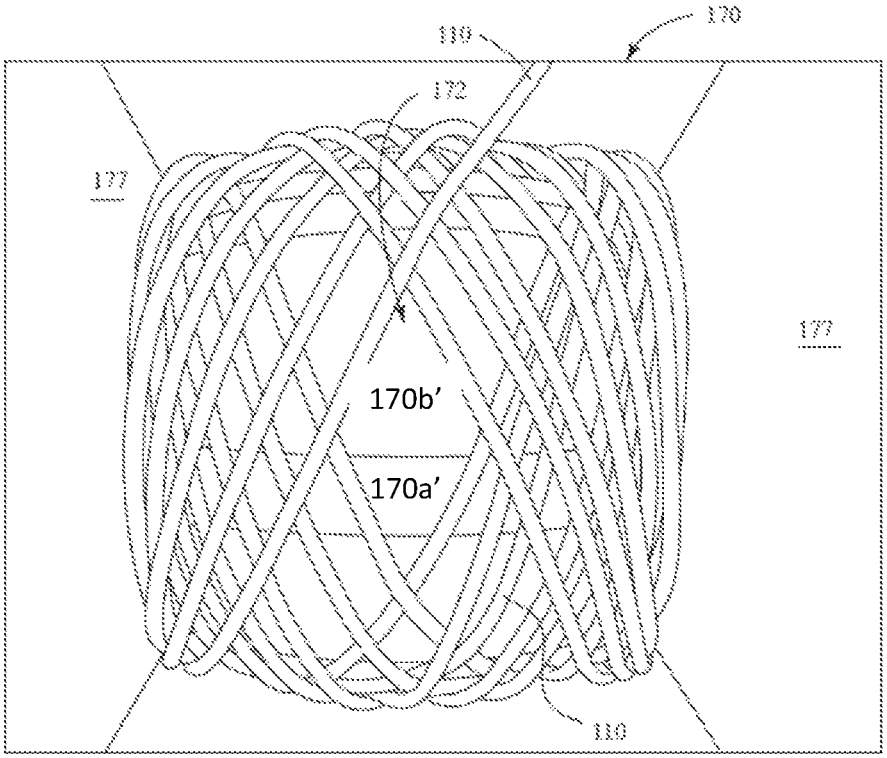
FIG. 9 shows a view of the mandrel and cable after an initial period of winding.

The start of the winding process is seen in FIG. 9, where a first layer of the wire 110 is seen laid down on the mandrel 170 with portions of the surface of the mandrel segments 170*a*' and 170*b*' still being seen. In FIG. 9, the first layer is complete in that the movement of the traverse has completed a "super-cycle" such that further laying down of wire will be located directly above (i.e., radially further away from the mandrel) where previous wire was laid down. This may also be appreciated by recognizing that a payout hole 172 is fully defined. In one embodiment, the dancer or tensioner 114 causes the tension on at least the first two layers of wire 110 laid down on the mandrel 170 by the traverse 164 to be at a relatively lower tension relative to the tension applied on the remainder of the wire as it is wound onto the mandrel 170. In another embodiment, the tension on a predetermined length of wire that is laid down as the first two to four layers of wire is tensioned at a tension that is lower relative to the tension applied to the remainder of the wire.

As will be appreciated, in order to effect winding of a coil with the first two or more layers or a desired length of wire at a first lower tension and succeeding layers at higher tension(s), the controller 118 may be programmed to send signals to the digital pressure regulator 152 of the dancer 114 to control the pressure in the lower chamber of the pneumatic cylinder 146. In particular, at the start of the winding of a coil, the controller 118 may send a signal to the digital pressure regulator 152 to provide a low tension on the wire 110. Then, based on the monitoring of the winding, for example, by using an encoder to monitor the amount of wire leaving the accumulator, the controller 118 may send a signal to the digital pressure regulator 152 to increase the tension on the wire 110 in accord with any desired profile.

FIGS. 10A to 13A illustrate details of the aforementioned cutter/grabber positioning system 1000. The positioning system 1000 is configured to position the cutter/grabber 1001 along the path 350 while maintaining the cutter/grabber 1001 in a substantially horizontal and level orientation. The positioning system 1000 includes the multi-jointed arm 1002, a first drive unit 1004, and a second drive unit 1006. The multi-jointed arm 1002 is configured to flex in a single x-y plane (see FIG. 10A) by action of a first drive unit 1004. The arm 1002 and first drive unit 1004 are coupled together and are suspended from a set of rails 1008, which are fixed to the take-up unit 116 at a location above the arm 1002. The rails 1008 extend parallel to a z-axis (see FIG. 10A), perpendicular to the plane of the arm 1002 (i.e., the x, y, and z axes are orthogonal). The rails 1008 permit the arm 1002 and first drive unit 1004 to move parallel to the z-axis. The second drive unit 1006 is also configured to be fixed to the take-up unit 116 above the rails 1008 and is configured to drive movement of the arm 1002 and the first drive unit 1004 along the rails 1008, i.e., in the z-axis direction which is parallel with the direction of movement of the traverse 164. Thus, the positioning system 1000 is capable of three-dimensional movement of the cutter/grabber 1001. Further details of the portions of the positioning system 1000 will now be described with reference to FIGS. 11, 11A, 11B, 12, 12A, 12B, and 13.

Figure 10B:
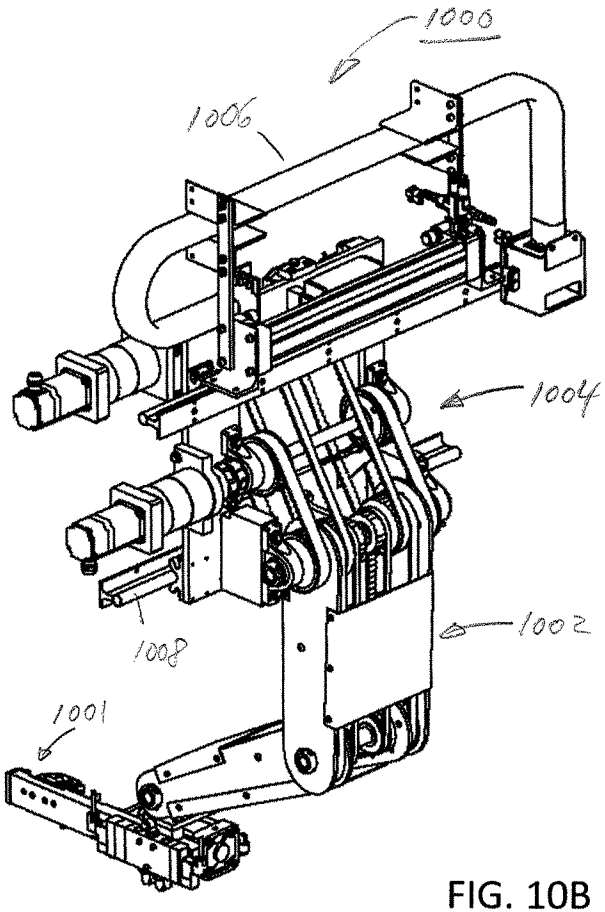
FIGS. 10A and 10B illustrate a cutter/grabber positioning system.
Figure 10A:
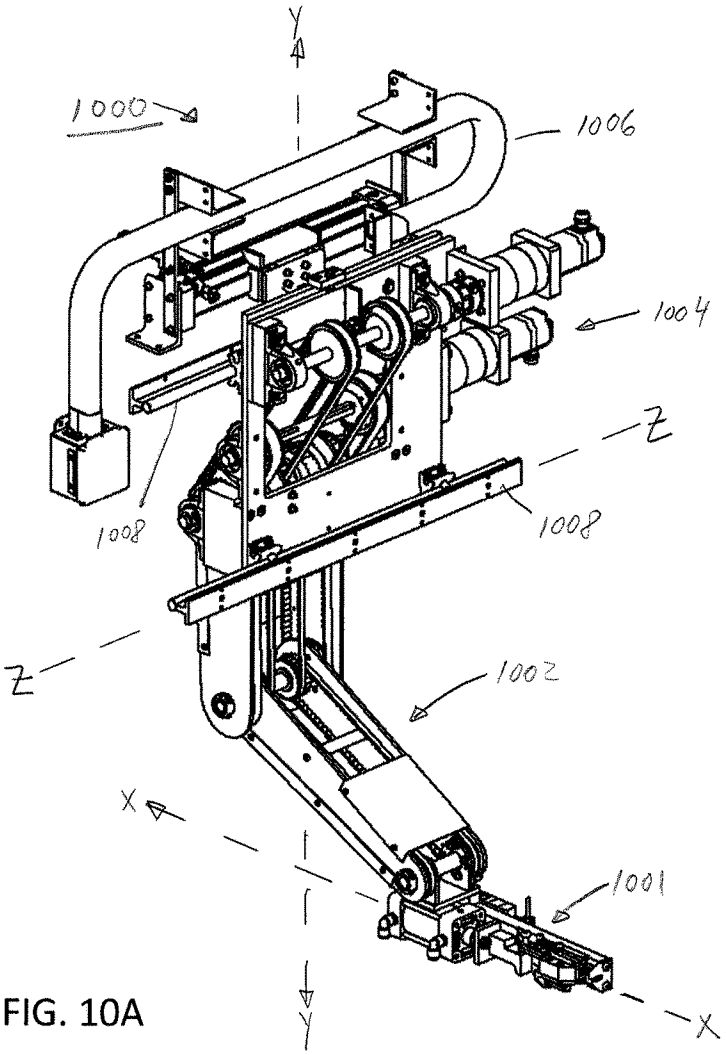
Figure 11:
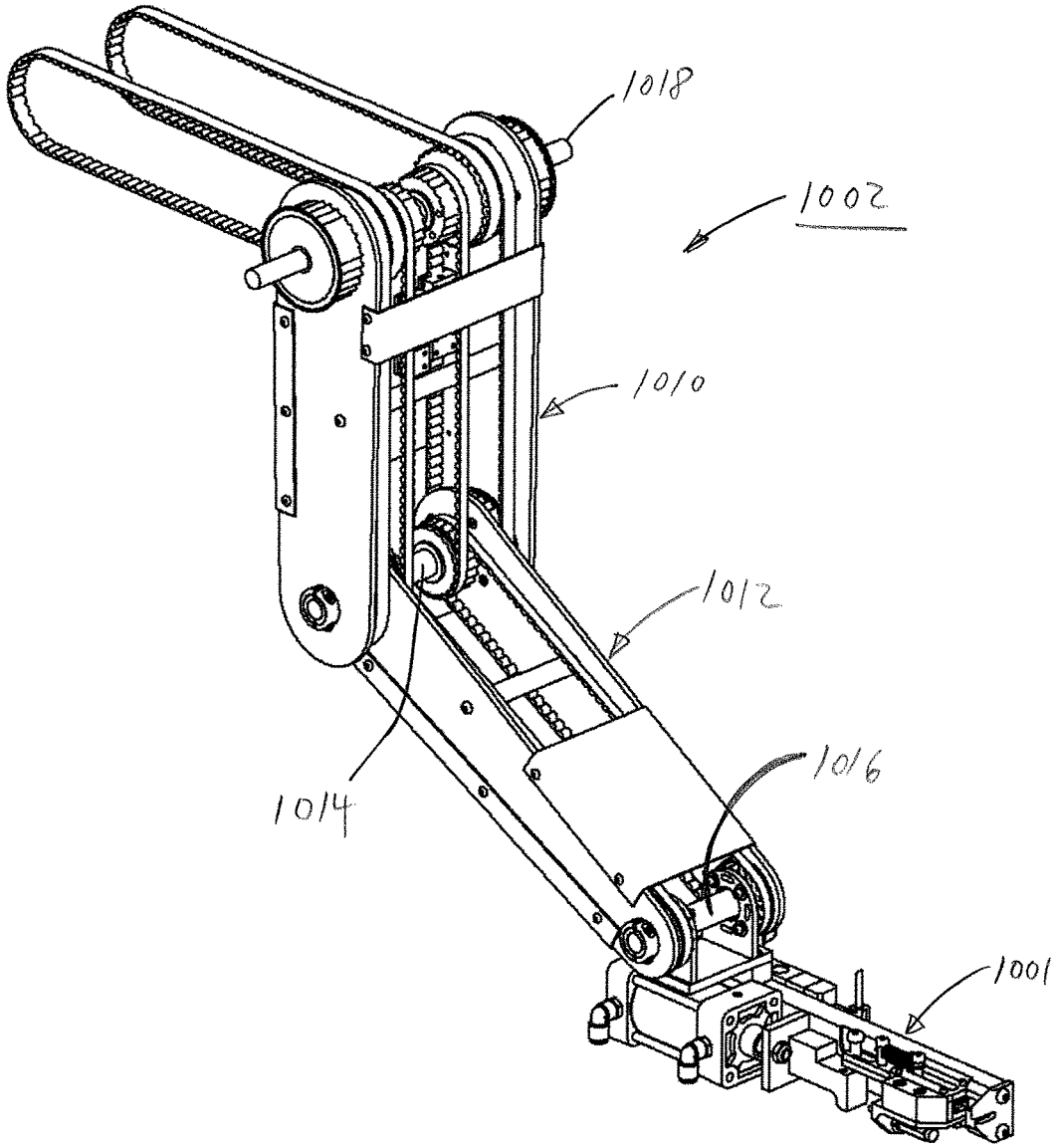
FIG. 11 illustrates an arm of the system of FIGS. 10A to 10C shown with the cutter/grabber.
Figure 11A:
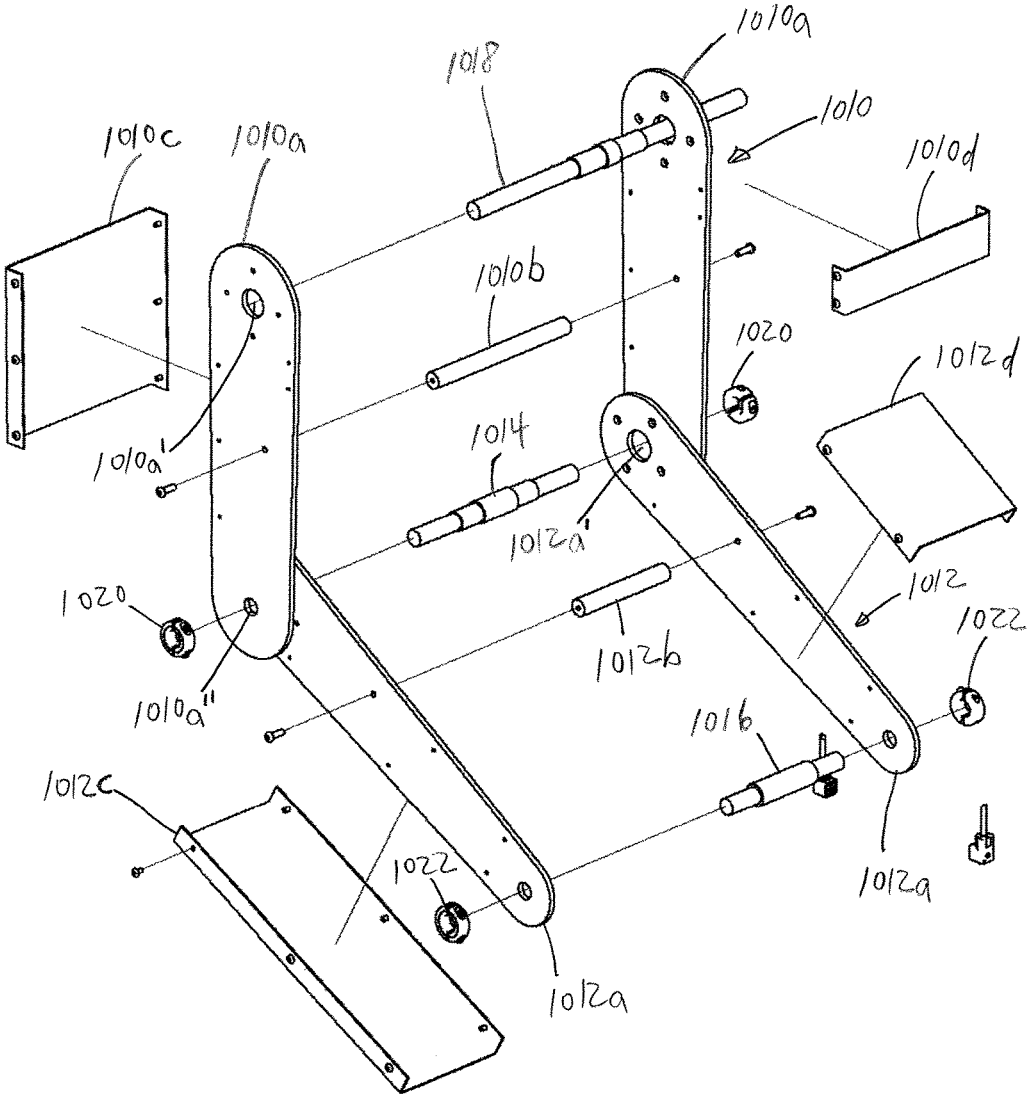
FIG. 11A is an exploded assembly view of a portion of the arm of FIG. 11 shown without a transmission system of the arm.

As shown in FIGS. 11 and 11A (and also 11B), the arm 1002 includes an upper arm 1010 and a lower arm 1012 that are pivotally connected with an axle 1014 that extends parallel with the z-axis. The connection of the upper arm 1010 and the lower arm 1012 at the axle 1014 defines an elbow joint. The cutter/grabber 1001 is pivotally connected to the lower arm 1012 at a wrist joint at a distal end of the lower arm 1012. An axle 1016 pivotally connects the lower arm 1012 to the cutter/grabber 1001. Turning momentarily back to FIG. 10A, a proximal end of the upper arm 1010 is pivotally connected to the first drive unit 1004 by an axle 1018, defining a shoulder joint of the arm 1002.

The upper and lower arms 1010 and 1012 are structurally formed as respective frames shown in FIG. 11A. The upper arm 1010 includes side links 1010*a* that are spaced apart and connected by a brace 1010*b*, and rear and front plates 1010*c* and 1010*d*. The brace 1010*b* and plates 1010*c*, 1010*d* maintain side links 1010*a* in fixed relation to one another so that the entire upper arm 1010 moves as a unitary member.

The lower arm 1012 includes side links 1012*a* that are spaced apart and connected by a brace 1012*b*, and rear and front plates 1012*c* and 1012*d*. The brace 1012*b* and plates 1012*c*, 1012*d* maintain side links 1012*a* in fixed relation to one another so that the entire lower arm 1012 moves as a unitary member.

The side links 1010*a* of the upper arm 1010 define holes 1010*a*' at their proximal ends through which the axle 1018 extends. Also, the side links 1010*a* define holes 1010*a*" at their distal ends and the side links 1012*a* define holes 1012*a*' at their proximal ends. The holes 1010*a*" and 1012*a*' align with one another to receive the axle 1014. Retaining collars 1020 are connected to the respective ends of the axle 1014. The side links 1012*a* define holes 1012*a*" at their distal ends through which the axle 1016 extends. Retaining collars 1022 are connected to the respective ends of the axle 1016.

Figure 11B:
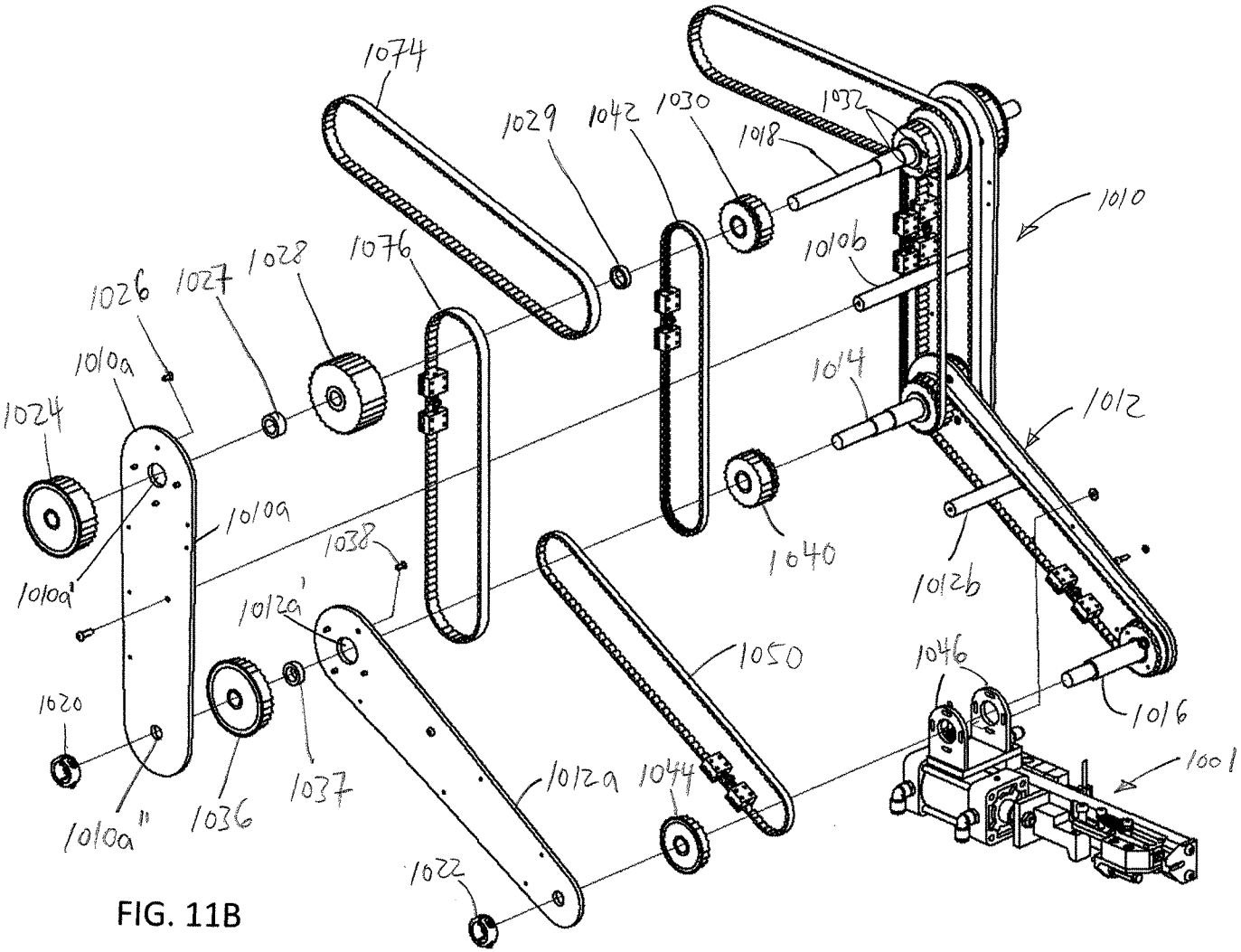
FIG. 11B is an exploded assembly view of the arm of FIG. 11 shown with the transmission system of the arm.

The upper and lower arms 1010 and 1012 are configured to articulate in a common x-y plane owing to an arrangement of geared belts and geared pulleys shown in FIG. 11B, which are driven by the first drive unit 1004.

Various pulleys are arranged on axle 1018. A pair of driven geared shoulder pulleys 1024 are fixedly attached with fasteners (e.g., screws) 1026 to an outer surface of the proximal ends of the side links 1010*a* of the upper arm 1010. The shoulder pulleys 1024 are fastened with screws 1026 to the side links 1010*a* so that the shoulder pulleys 1024 and the upper arm 1010 rotate in unison about axle 1018. The shoulder pulleys 1024 are not fixed to the axle 1018. Proceeding inward from the shoulder pulleys 1024 along the axle 1018 is a spacer 1027 and geared idler elbow pulleys 1028, which are not fixed to the axle 1018. The spacer 1027 spaces idler elbow pulleys 1028 from shoulder pulleys 1024 along the axle 1018. The hole 1010*a*' in the proximal end of side link 1010*a* is large enough so that an inner edge of the side link 1010*a* around the hole 1010*a*' does not contact the spacer 1027. Geared upper elbow drive belts 1074 are wrapped around idler elbow pulleys 1028. Belt 1074 is geared like an automotive timing belt.

Proceeding inward along axle 1018 from the idler elbow pulleys 1028 are spacers 1029 and geared idler wrist pulleys 1030, which are also not fixed to the axle 1018. The spacers 1029 space idler elbow pulleys 1028 from idler wrist pulleys 1030 along the axle 1018. The idler wrist pulleys 1030 define through holes 1032 that are configured to receive pins 1034 (FIG. 12A) to fix the idler wrist pulleys 1030 to the first drive unit 1004.

Various pulleys are also arranged on axle 1014. A driven geared elbow pulley 1036 is sandwiched between the distal end of side links 1010*a* and the proximal end of side links 1012*a*. Each driven elbow pulley 1036 is fixedly attached with fasteners 1038 (e.g., screws) to an outer surface of the proximal end of each side link 1012*a* so that the elbow pulleys 1036 and the lower segment 1012*a* move in unison about axle 1014. A lower geared elbow drive belt 1076 wraps around elbow idler pulley 1028 and driven elbow pulley 1036. When the upper elbow drive belt 1074 moves, it causes lower elbow drive belt 1076 to move, which causes driven elbow pulley 1036 to rotate in unison with lower arm 1012 about axle 1014, which, thereby alters the angle between the lower arm 1012 and a base orthogonal plane.

Proceeding inwardly along axle 1014 from the elbow pulleys 1036 are side links 1012, spacers 1037 and geared idler wrist pulleys 1040, which are not fixed to the axle 1014. The spacers 1037 space idler wrist pulleys 1040 from elbow pulleys 1036 along axle 1014. The hole 1012*a*' in the proximal end of side link 1012*a* is large enough so that an inner edge of the side link 1012*a* around the hole 1012*a*' does not contact the spacer 1037. Idler wrist pulleys 1040 are connected to idler wrist pulleys 1030 on axle 1018 with a geared upper wrist belt 1042.

Driven wrist pulleys 1044 are arranged on axle 1016 on either side of a mount 1046 of the cutter/grabber 1001. The wrist pulleys 1044 are not fixed to axle 1016. The driven wrist pulleys 1044 are fixed with fasteners 1048 (e.g., screws) to the mounts 1046 of the cutter/grabber 1001. The driven wrist pulleys 1044 are connected to the idler wrist pulleys 1040 on axle 1014 with geared lower wrist belts 1050. The wrist pulleys 1030, 1040, and 1044, and upper and lower belts 1042 and 1050 are arranged to maintain the cutter/grabber in a horizontal position regardless of the rotation of the upper or lower arms 1010 and 1012, as will be described in greater detail below.

Figure 12:
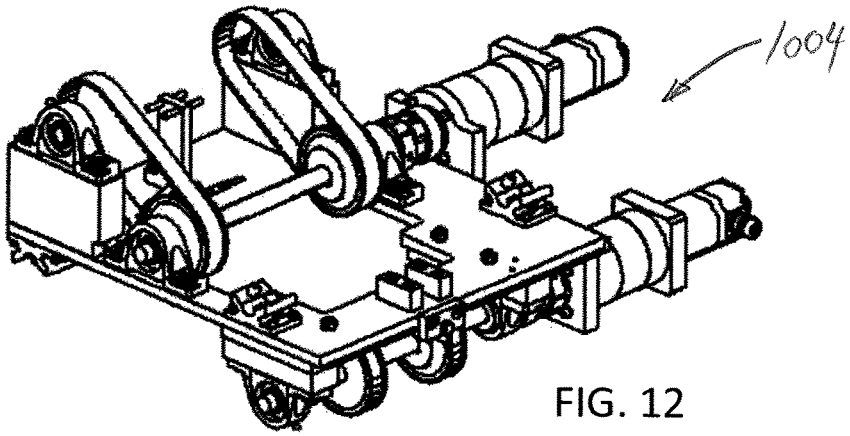
FIG. 12 illustrates a first drive unit of the system of FIGS. 10A to 10C.
Figure 12A:
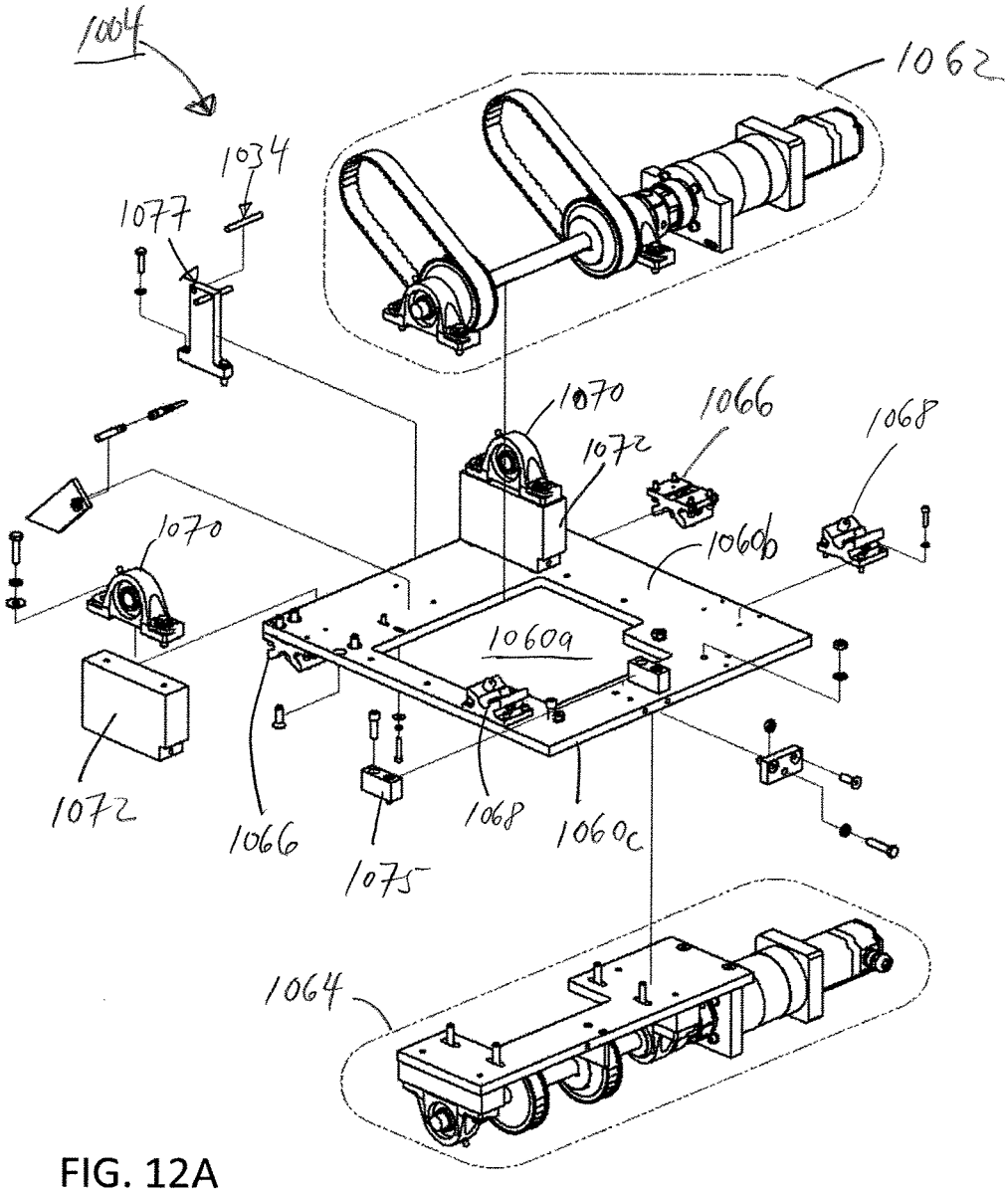
FIG. 12A is an exploded assembly view of the stepper drive assembly of FIG. 12.
Figure 12B:
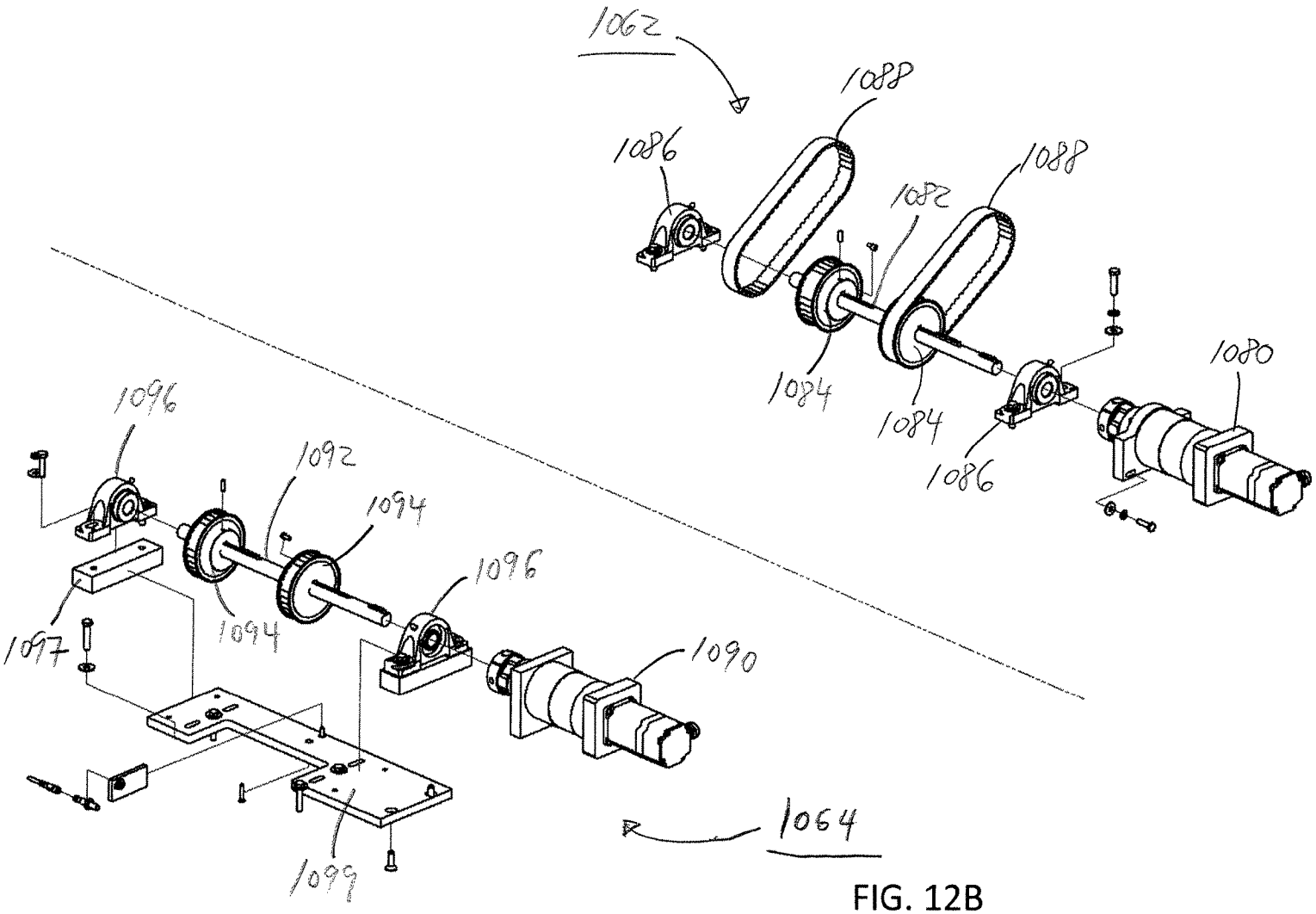
FIG. 12B are exploded views of a shoulder drive unit and an elbow drive unit shown in FIG. 12A.

FIGS. 12 to 12B shows details of the first drive unit 1004. The first drive unit 1004 includes a carrier plate 1060, and a shoulder drive unit 1062, and an elbow drive unit 1064 mounted to the carrier plate 1060. As noted above, the first drive unit 1004 is configured to move along rails to position the arm 1000. To provide such movement, bearings 1066 are located on a front side 1060*c* of the carrier plate 1060 and bearings 1068 are located on a rear side 1060*b* of the carrier plate 1060.

Bearings 1070 are mounted to the rear side 1060*b* of the carrier plate 1060 and the bearings 1070 are spaced from the rear side with spacers 1072. The bearings 1070 are configured to receive and retain the ends of shaft 1018. A wrist arrester bracket 1077 extends from the rear side 1060*b* of the carrier plate 1060 and is centered between the bearings 1070. The aforementioned pins 1034 extend through a distal end of the bracket 1077. As noted above, the pins 1034 interlock with holes 1032 (FIG. 11B) in wrist pulleys 1030 and fix the position of those pulleys relative to the carrier plate 1060.

The shoulder drive unit 1062 is mounted to the rear side 1060*b* of the carrier plate 1060 and the elbow drive unit 1064 is mounted to the front side 1060*c* of the carrier plate 1060. The carrier plate 1060 defines an opening 1060*a* which provides clearance for passage of upper elbow drive belts 1074, which are driven by the elbow drive unit 1064.

A pair of blocks 1075 are mounted to the rear side 1060*b* of the carrier plate 1060. The blocks 1075 are spaced from one another a distance to receive a carrier guide 1302 (FIG. 13) mounted to a driver 1300 (FIG. 13) of the second drive unit 1006, as described in greater detail below.

FIG. 12B shows details of the shoulder and elbow drive units 1062 and 1064. The shoulder drive unit 1062 includes a shoulder driver 1080, which is preferably an electric stepper motor that may be coupled to a reducer to achieve a desired torque. The shoulder drive unit 1062 also includes a keyed shaft 1082 that is coupled to and driven by the shoulder driver 1080. The shoulder drive unit 1062 includes keyed arm drive pulleys 1084 that are fixed to the shaft 1082 and rotate in unison therewith. The shaft 1082 is supported by a set of bearings 1086, which are attached to the rear side 1060*b* of the carrier plate 1060. The shoulder drive unit 1062 is coupled to the shoulder pulleys 1024 (FIG. 11B) with shoulder belts 1088 so that when the shoulder driver 1080 drives and rotates the shaft 1082 and the shoulder drive pulleys 1088, the rotation of the shoulder drive pulleys 1088 will cause rotation of the shoulder pulleys 1024 and the upper arm 1010.

The elbow drive unit 1064 includes an elbow driver 1090, which is preferably an electric stepper motor that may be coupled to a reducer to achieve a desired torque. The elbow drive unit 1064 also includes a keyed shaft 1092 that is coupled to and driven by the driver 1090. The elbow drive unit 1064 includes keyed elbow drive pulleys 1094 that are fixed to the shaft 1092 and rotate in unison therewith. The shaft 1092 is supported by a set of bearings 1096, which are attached to the front side 1060*c* of the carrier plate 1060 via spacers 1097 and plate 1099. The elbow drive unit 1064 is coupled to the idler elbow pulleys 1028 (FIG. 11B) with the upper elbow belts 1074 (FIG. 11B) so that when the elbow driver 1090 drives rotation of the shaft 1092 and the elbow drive pulleys 1094, the rotation of the elbow drive pulleys 1094 will cause rotation of the elbow pulleys 1028 and 1036 and the lower arm 1012.

Figure 10C:
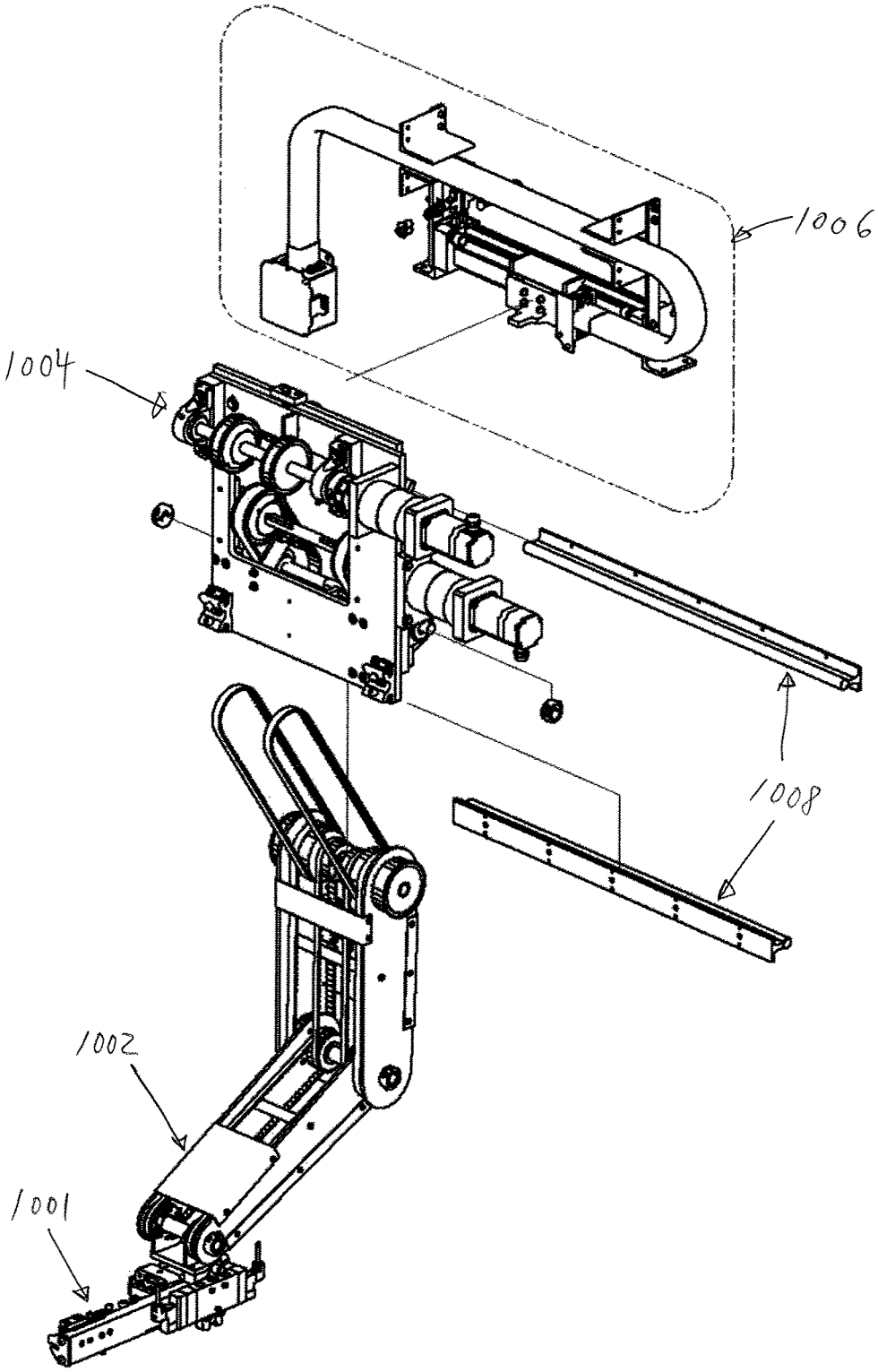
FIG. 10C is an exploded assembly view of the cutter/grabber positioning system shown in FIGS. 10A and 10B.
Figure 13:
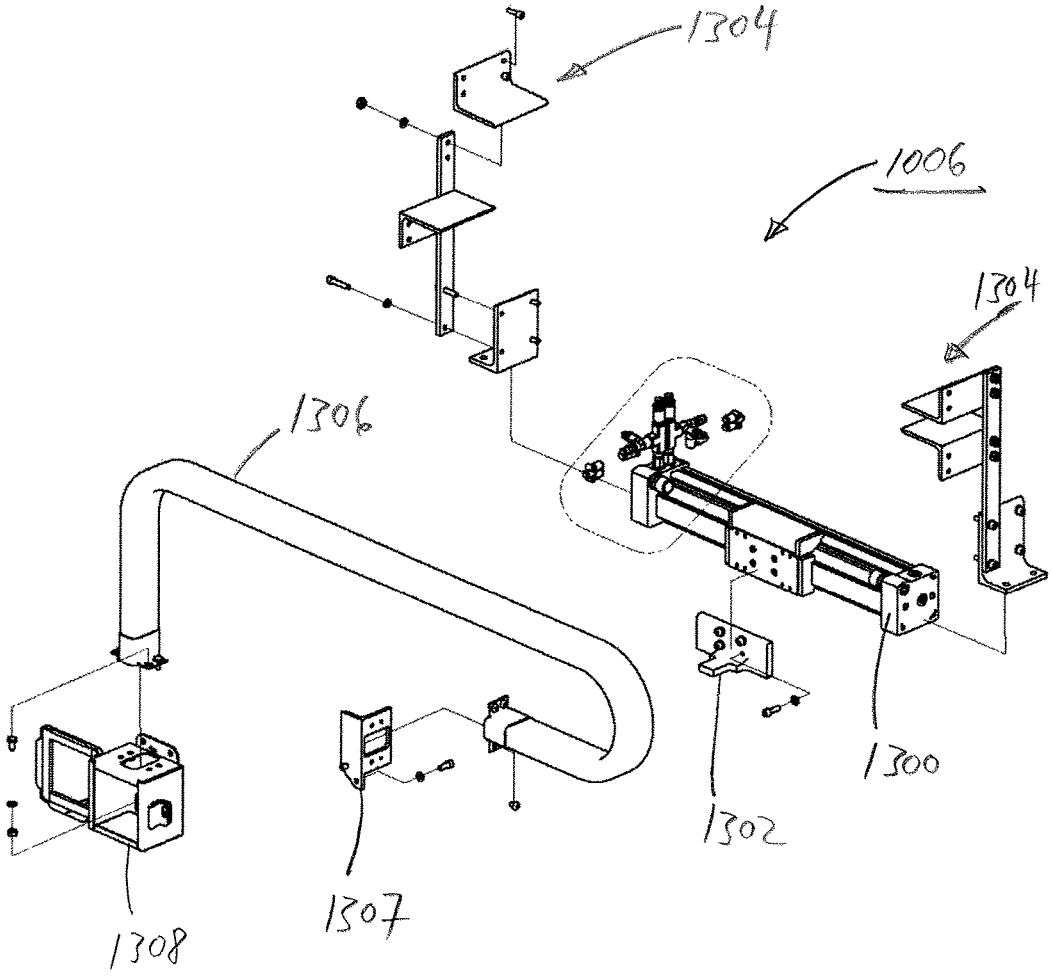
FIG. 13 illustrates a second drive unit of the system of FIGS. 10A to 10C along with electrical and pneumatic connections for the arm of FIGS. 10A to 10C.

FIG. 13 show details of the second drive unit 1006. The second drive unit 1006 includes the driver 1300, which is preferably an air cylinder. The carrier guide 1302 is mounted to the driver 1300 for linear movement along the z axis. The movement of the carrier driver 1302 is driven by the driver 1300. The driver 1300 is fixed to the machine 116 by brackets 1304. The carrier guide 1302 is configured to be located between the blocks 1075 (FIG. 12A) on the rear side 1060*b* of the carrier plate 1060, movement of the carrier guide 1302 by the driver 1300 will cause movement of the carrier plate 1060 and the arm 1000 in the z axis direction along rails 1008 (FIG. 10C).

The brackets 1304 also support a flexible electrical and pneumatic conduit 1306, which is connected via bracket 1307 at one end to the carrier plate 1060 and fixed at another end to a junction box 1308. When the carrier plate 1060 moves along the z axis, the flexible conduit 1306 can flex and move with the carrier plate 1060. The conduit 1306 can distribute electrical power and pressurized air to the shoulder driver 1080 and the elbow driver 1090. In one embodiment, the conduit houses at least one of electrical wires for the aforementioned stepper motors, switches and pneumatic valves, and an air line (e.g., compressed air) to supply the air cylinder of the cutter driver 1418.

Figure 14A:
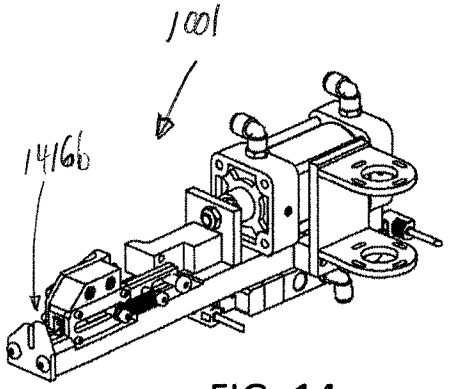
FIG. 14A is an isometric view of the cutter/grabber of FIG. 14 in its assembled configuration.
Figure 14:
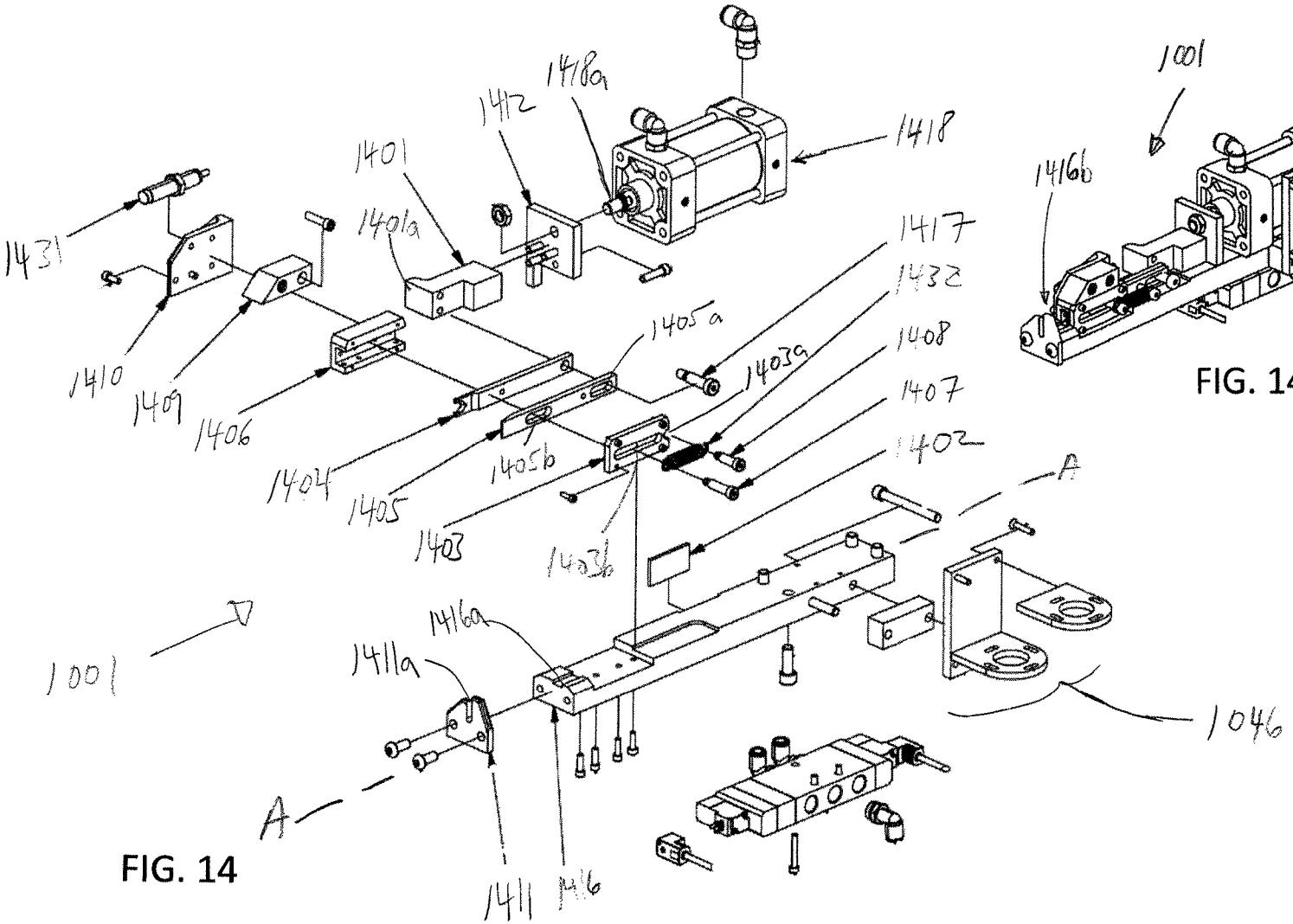
FIG. 14 is an exploded assembly view of the cutter/grabber shown in FIGS. 10A, 10B, 10C, 11, and 11B.

FIG. 14 is an exploded view of the cutter/grabber 1001 shown in FIGS. 10A, 10B, 10C, 11, and 11B. The cutter/grabber 1001 includes a base 1416 to which a cutter/grabber holder 1406, a strike plate 1411, a driver 1418, and the mount 1046 (FIG. 11B) are attached. A bladed cutter 1404 for cutting supply wire, and a grabber 1405 for grabbing the free end of the cut supply wire extend axially along axis A-A and are housed between the cutter/grabber holder 1406 and a cover 1403, which maintains the cutter 1404 and the grabber 1405 parallel to one another and with the axis A-A. The cutter 1404 and grabber 1405 are configured to selectively move, under the control of the driver 1418, axially from a retracted position (shown in FIG. 14) toward the strike plate 1411 to an extended position in which the cutter cuts the wire and the grabber grabs the wire. A groove 1416*a* is formed in the base 1416 parallel to axis A-A in which the cutter 1404 and grabber 1405 move.

The driver 1418 may be a double acting air cylinder configured to selectively actuate and thereby cause its shaft 1418*a* to translate axially along axis A-A from a retracted position (shown in FIG. 14) corresponding to the retracted position of the cutter 1404 and grabber 1405 to an extended position corresponding to the extended position of the cutter 1404 and grabber 1405.

The cutter 1404 and grabber 1405 are connected to a drive block 1401 with a bolt 1417 and are all configured to move axially along axis A-A with respect to the base 1416. The grabber 1405 has elongated holes 1405*a* and 1405*b*, which permit some relative axial movement between the cutter 1404 and the grabber 1405. Such relative movement between the cutter 1404 and the grabber 1405 is controlled by an arrangement of bolts 1407, 1408, and a spring 1432. A proximal bolt 1408 is fastened to grabber 1405 at a location spaced slightly distally of elongated hole 1405*a*. The cover 1403 defines a proximal notch 1403*a* that is configured to engage the proximal bolt 1408 and act as a positive stop to limit the axial movement of grabber 1405 in the distal direction (i.e., toward the strike plate 1411) when the grabber 1405 is in its extended position. Also, the cover 1403 defines an axially extending elongated slot 1403*b*. The proximal bolt 1407 extends through the elongated slot 1403*b*, through the elongated slot 1405*b* in the grabber 1405, and is connected to the cutter 1404. The elongated slot 1403*b* acts as a track for the proximal bolt 1407 and the ends of the slot 1403*b* provide positive stops for the proximal bolt 1407 and the cutter 1404 attached thereto. The spring 1432 is connected at its ends to the bolts 1407 and 1408. The spring 1432 has an unextended, neutral position when the cutter 1404 and grabber 1405 are positioned in their retracted position. The spring 1432 extends to permit relative axial displacement between the cutter 1404 and the grabber 1405, as will be described in greater detail below.

The drive block 1401 is connected to a thrust plate 1412, which is connected to the shaft 1418*a* of the driver 1418. The thrust plate 1412 is maintained perpendicular to the axis A-A and prevented from rotating about axis A-A by a bearing surface 1402 connected to the base 1416. Thus, the drive block 1401, bolt 1417, thrust plate 1412, cutter 1404, grabber 1405, bolts 1407 and 1408, and spring 1432 can be driven axially together by the shaft 1418*a* of the driver 1418 when it moves from its retracted position to its extended position, although the grabber 1405 and bolt 1408 may move relative to the rest of the parts as allowed by the elongation of the spring 1432.

A wire cutter guide 1409 is fixed to the cutter/grabber holder 1406 with a mount plate 1410. The wire cutter guide 1409 and the cutter/grabber holder 1406 are axially spaced a predetermined distance from the strike plate 1411, thereby defining a wire receiving channel 1416*b* (FIG. 14A) for receiving a wire to be cut across the channel 1416*b*. For example, when the cutter/grabber 1001 is at the cut position 350*b* (FIG. 3A), the supply wire to be cut may be received in the channel 1416*b* (FIG. 14A) and may extend in a direction that is transverse to the axis A-A and located across slot 1416*a* in the path of axial movement of the cutter 1404 and the grabber 1405. The strike plate 1411 defines a slot 1411*a* that is located in alignment with the slot 1416*a* and the cutter 1404 so that when the cutter 1404 moves from its retracted position to its fully extended position, the distal end of the cutter 1404 (i.e., its blade) will slice through the wire in the channel 1416*b* (FIG. 14A) (e.g., like a guillotine) and through the slot 1411*a*.

A shock 1431 is connected to the mount plate 1410. The shock 1431 is configured to engage a distal shoulder 1401*a* of the drive block 1401 when the cutter 1404 is in its extended position only after the wire 110 has been severed. The shock 1431 provides an adjustable, positive stop to control how far the cutter 1404 travels distally through the slot 1411*a* of the strike plate 1411. The full force of the driver 1418 should be transmitted to the wire 110 until it is cut. Once the wire 110 is cut, the shock 1431 slows down the driver 1418 and the drive block 1401 so the eventual stop is not so abrupt.

The operation of the cutter/grabber 1001 is as follows. As noted above, the cutter/grabber 1001 is moved to the cut position 350*b* to cut and grab wire. When the cutter/grabber 1001 is in the cut position 350*b* (FIG. 3A), the wire extends across the channel 1416*b*, and the slot 1416*a* in the path of the cutter 1404 and the grabber 1405. When the wire is so positioned in the channel 1416*a*, the driver 1418 may be actuated to move its shaft 1418*a* from its retracted position to its extended position. As noted above, the shaft 1418*a* is directly connected to the drive block 1401 and bolt 1417, so that initially upon movement of the shaft 1418*a*, the bolt 1417 (along with the cutter 1404 and the grabber 1405) will begin moving axially in a distal direction towards the strike plate 1411. Upon initial axial movement of the cutter 1404 and the grabber 1405, the spring 1432 will prevent relative axial displacement between the cutter 1404 and the grabber 1405 so that they will both move distally together until distal bolt 1408 engages the proximal notch 1403*a*. When distal bolt 1408 engages the proximal notch 1403*a*, the grabber 1405 will not be able to advance further in the distal direction due to its connection to the distal bolt 1408. This condition corresponds to the fully extended position of the grabber 1405. It is expected that in the fully extended position of the grabber 1405, the distal end of the grabber 1405 compresses the wire in the channel 1416*b* against the strike plate 1411 to hold the wire 110 before it is cut by the cutter 1404.

Further, because slots 1405*a* and 1405*b* are elongated, even when the grabber 1405 is in its extended position holding the wire against the strike plate 1411, the cutter 1404 can slide relative to the grabber 1405 and continue to advance distally beyond grabber 1405 to cut the wire and move through slot 1411*a*. Thereafter, the cutter 1404 advances distally until the bolt 1417 engages the distal end of slot 1405*a* in grabber 1405 or the limit of shock 1431 is reached, at which point the cutter 1404 cannot move further in the distal direction, which corresponds to the fully extended position of the cutter 1404. When the cutter 1404 is in the fully extended position, the spring 1432 will be extended an amount, which will exert a force pulling distally on the grabber 1405 so that the grabber 1405 maintains pressure on the wire 110, which pressure on the wire 110 is applied beginning upon contact with the grabber 1405 and increases as the cutter 1404 continues to move distally and the spring continues to elongate. A retraction of the shaft 1418*a* of the driver 1418 will cause the cutter 1404 and the grabber 1405 to return to their retracted positions shown in FIG. 14.

Arm 1000 operates as follows. The arm 1000 may be controlled by the controller 118 to operate the first and second drive units 1004 and 1006 to move the cutter/grabber 1001 along the path 350. The belts and pulleys are arranged to maintain the orientation of the upper arm, lower arm, and grabber independently of one another. To facilitate this capability, belts 1088 and 1074 remain stationary and substantially locked in place when their corresponding shoulder and elbow drive units 1062 and 1064 are not operating. Also, as noted above, the idler wrist pulleys 1030 remain fixed to the carrier plate 1060 so that belt 1042 always remains stationary during rotational movement of the upper and lower arms 1010 and 1012. For example, in the example shown in FIG. 11B, the angle between the lower arm 1012 and the horizontal plane (e.g., the floor) is about 30 degrees. If, in the example position in FIG. 11B, only the upper arm 1010 is rotated counterclockwise by 90 degrees, the angle between the lower arm 1012 and the horizontal will be maintained at 30 degrees as follows.

When the elbow drive unit 1064 is off, the upper elbow belts 1074 and the elbow idler pulleys 1028 remain stationary relative to the upper arm 1010. When the upper arm 1010 rotates 90 degrees by action of the shoulder drive unit 1062, the driven elbow pulleys 1036 and the belt 1076 travel in a 90 degree arc about the axle 1018. However, pulleys 1036 and the lower arm 1012 are supported by the axle 1014, which is also connected to the upper arm 1010. Thus, as the belt 1076 and upper arm 1010 swing about axle 1018, the geared belt 1076 cannot slide or slip, and the geared teeth of the pulley 1036 will ride (rotate) along the inside geared surface of the belt 1042 to maintain the angular position of the lower arm 1012. Therefore, when the upper arm 1010 has swung counterclockwise 90 degrees, the pulleys 1036 will have rotated 90 degrees clockwise relative to upper arm 1010.

The foregoing principle is also applicable to the wrist joint. When the upper arm 1010 rotates 90 degrees about axle 1018, idler wrist pulley 1040 and belt 1042 travel in a 90 degree arc, similar to elbow pulley 1036 described above. Just as in the case of elbow pulley 1036, the belt 1042 is fixed and cannot slide or slip, but the geared idler wrist pulley 1040 is free to travel along the geared inside surface of belt 1042 and rotate. The movement of the pulley 1040 along the belt 1042 will cause movement of the belt 1050 and the wrist pulleys 1044, which are in fixed relation with cutter/grabber 1001 about axle 1016. The movement of the belt 1050 will maintain the angle of the cutter/grabber 1001 horizontal even when the upper arm 1010 is rotated 90 degrees in the example.

Also, it will be appreciated that when the elbow drive unit 1064 is operated and the shoulder drive unit 1062, the cutter/grabber 1001 will maintain its horizontal position. Thus, regardless of which portion of the arm 1002 moves, the cutter/grabber 1001 will maintain its horizontal position. For example, in the example shown in FIG. 11B, if the lower arm 1012 is rotated counterclockwise about axle 1014 by operation of the elbow drive unit 1064, then the axle 1016, pulleys 1044, and belts 1050 will travel with the lower arm 1012 in an arc about axle 1014. As the geared pulleys 1044 travel in their arcs, they will ride along the geared inside surface of respective belts 1050 so that as the lower arm 1012 rotates counterclockwise, the pulleys 1044 and the cutter/grabber 1001 will rotate clockwise with respect to the lower arm 1012 to maintain the cutter/grabber 1001 at the horizontal orientation in FIG. 11B.

It will be appreciated that the system 100 has been described as including a controller 118. The controller 118 is shown as a separate unit, but it should be appreciated that the controller may also reside with the take-up unit 116, the dancer 114, or the payoff unit 112, or may be distributed amongst them. The controller 118 may have a touch-screen or other interface that permits a user to select a tension control profile for the coil, positions and speeds for the arm and various other components of the system, and includes a processor or processing system. The terms "processor" and "processing system" (hereinafter "processing system") should not be construed to limit the embodiments disclosed herein to any particular device type or system. The processing system may be a laptop computer, a desktop computer, or a mainframe computer. The processing system may also include a processor (e.g., a microprocessor, microcontroller, digital signal processor, programmable logic controller, or general purpose computer) for executing any of the methods and described above. The processing system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device. This memory may be used to store, for example, positions of the cutter/grabber along the pathway 350, tension parameters, coil lengths at which the tension is changed, and instructions for performing the methods described above.

Any of the methods described above can be implemented as computer program logic for use with the processing system. The computer program logic may be embodied in various forms, including a source code form or a computer executable form. Source code may include a series of computer program instructions in a variety of programming languages (e.g., an object code, an assembly language, or a high-level language such as FORTRAN, C, C++, or JAVA). Such computer instructions can be stored in a non-transitory computer readable medium (e.g. memory), and executed by the processing system. The computer instructions may be distributed in any form as a removable storage medium with accompanying printed or electronic documentation (e.g. shrink wrapped software), preloaded with a computer system (e.g. on system ROM or fixed disk), or distributed via Internet Protocol (IP).

There have been described and illustrated herein several embodiments of an apparatus and method for winding a coil. While particular embodiments have been described, it is not intended that the invention be limited thereto, as it is intended that the invention be as broad in scope as the art will allow and that the specification be read likewise. It will therefore be appreciated by those skilled in the art that modifications could be made to the provided invention without deviating from its spirit and scope as claimed. In the claims, means-plus-function clauses, if any, are intended to cover the structures described herein as performing the recited function and not only structural equivalents, but also equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for winding wire, comprising:

a) a wire take-up unit including a rotatable first mandrel portion, a rotatable second mandrel portion, a third mandrel portion which is configured to alternately join with the first and second mandrel portions to form a complete mandrel on which to wind wire into a coil, and a wire directing traverse, said traverse arranged to feed wire and alternately form coils on the first and second mandrel portions when joined to the third mandrel portion, wherein each coil is wound in a figure-eight configuration; and b) a wire cutter/grabber unit configured to cut the wire at a cut position between said traverse and a coil formed on said first mandrel portion and to grab a free end of the cut wire and move with the free end of the wire along a predefined cutter/grabber pathway to a hand-off position where the free end of the wire is transferred to said second mandrel portion, wherein as the cutter/grabber is moved along the cutter/grabber pathway from the cut position to the hand-off position, the length of wire between said traverse and the free end of the wire does not decrease, and the length of wire between the traverse and the free end of the wire is longer at the hand-off position than at the cut position.

2. A system according to claim 1, wherein:

said cutter/grabber is configured to move from a wait-to-cut position to the cut position, wherein the wait-to-cut position is within six inches of the traverse.

3. A system according to claim 2, wherein:

the wait-to-cut position is within three inches of the traverse.

4. A system according to claim 1, wherein:

the second mandrel portion includes a clamp configured to hold the wire when the cutter/grabber and traverse are in the hand-off position.

5. A system according to claim 1, further comprising:

a cutter/grabber positioning system disposed vertically above the cutter/grabber and configured to position the cutter/grabber along the cutter/grabber pathway.

6. A system according to claim 5, wherein:

said positioning system includes a multi jointed arm configured to flex in a plane that is transverse to a plane in which the traverse is configured to move; and a first drive unit configured to flex the arm.

7. A system according to claim 5, wherein:

said positioning system includes a second drive unit configured to translate said arm and said first drive unit in a direction parallel to an axis along which said traverse is configured to travel.

8. A system according to claim 5, wherein:

said positioning system is configured to maintain said cutter/grabber in a horizontal orientation as the cutter/grabber moves throughout the cutter/grabber pathway.

9. A cutter/grabber system for resetting a wire take-up unit after forming a coil of wire, the wire take-up unit including a rotatable first mandrel portion and rotatable second mandrel portion, a third mandrel portion which is configured to alternately join with the first and second mandrel portions to form a complete mandrel on which to wind wire into a coil, and a wire directing traverse, said traverse arranged to feed wire and alternately form coils on the first and second mandrel portions when joined to the third mandrel portion, wherein each coil is wound in a figure-eight configuration, said cutter/grabber system comprising:

a wire cutter/grabber unit configured to move along a cutter/grabber pathway to separate a coil, formed on the first mandrel portion, from the traverse and set up the second mandrel portion for winding and forming the wire into another coil, the pathway including a plurality of distinct positions including a wait-to-cut position that is within six inches of the traverse, a cut position, a transfer position, a hand-off position, and a ready-to-wind position, wherein the cutter/grabber is configured to cut the wire at the cut position between the coil on the first mandrel portion and the traverse, grab a free end of the cut the wire from the traverse, and move with the free end of the wire to the hand-off position where the free end of the wire is transferred to said second mandrel portion, and wherein the cutter/grabber is also configured to move in a circuit between the wait-to-cut position, the cut position, the transfer position, the hand-off position, the ready-to-wind position, the circuit starting and ending at the wait-to-cut position.

10. A system according to claim 9, wherein:

as the cutter/grabber is moved along the cutter/grabber pathway from the cut position to the hand-off position, a length of wire between the traverse and the free end of the wire does not decrease, and the length of wire between the traverse and the free end of the wire is longer at the hand-off position than at the cut position.

11. A system according to claim 9, wherein:

at the transfer position, the cutter/grabber holds the free end of the wire while the first and second mandrel portions exchange places relative to the traverse.

12. A system according to claim 11, wherein:

the ready-to-wind position is vertically below the hand-off position.

13. A system according to claim 9, wherein:

at the hand-off position, the cutter/grabber and the traverse are relatively positioned to extend the wire across a grabber of the second mandrel portion.

14. A system according to claim 9, further comprising:

a cutter/grabber positioning unit coupled to the cutter/grabber unit and extending upward therefrom to a support position spaced vertically above the cutter/grabber unit, said cutter/grabber positioning unit configured to support and suspend the cutter/grabber unit below the support position.

15. A system for winding wire, comprising:

a) a wire take-up unit including a rotatable first mandrel portion and rotatable second mandrel portion, a third mandrel portion which is configured to alternately join with the first and second mandrel portions to form a complete mandrel on which to wind wire into a coil, and a wire directing traverse, said traverse arranged to feed wire and alternately form coils on the first and second mandrel portions when joined to the third mandrel portion, wherein each coil is wound in a figure-eight configuration;

b) a wire cutter/grabber unit configured to cut the wire at a cut position between said traverse and a coil formed on said first mandrel portion and to grab a free end of the cut wire and move along a predefined cutter/grabber pathway to a hand-off position where the wire is transferred to said second mandrel portion, wherein as the cutter/grabber is moved along the cutter/grabber pathway from the cut position to the hand-off position, a length of wire between said traverse and the free end of the wire does not decrease, and the length of wire between the traverse and the free end of the wire is longer at the hand-off position than at the cut position; and c) a cutter/grabber positioning system coupled to the wire take-up unit at an upper end and coupled to said cutter/grabber at a lower end, the cutter/grabber positioning system disposed vertically above the cutter/grabber and configured to position the cutter/grabber along the cutter/grabber pathway, said positioning system includes a multi jointed arm having an upper arm and a lower arm configured to pivot relative to one another in a plane common to the upper and lower arms and having a first drive unit configured to rotated at least one of the upper and lower arms, and said positioning system including a second drive unit configured to translate said arm and said first drive unit in a direction parallel to the traverse, wherein said positioning system is configured to maintain said cutter/grabber in a horizontal orientation as the cutter/grabber moves throughout the cutter/grabber pathway.

16. A system according to claim 15, wherein:

said arm includes a belt driven transmission system driven by the first drive unit.

17. A system according to claim 16, wherein:

said first drive unit includes a shoulder drive unit configured to rotate the upper arm about a shoulder joint of the arm, and includes an elbow drive unit configured to rotate the lower arm about an elbow joint of the arm between the upper arm and the lower arm, wherein the first drive unit is mounted on fixed rails for translation of the first drive unit in a direction parallel to the traverse.

18. A system according to claim 17, wherein:

said shoulder drive unit includes a shoulder driver including a stepper motor configured to drive geared belts connected to geared shoulder pulleys fixed to the upper arm, and said elbow drive unit includes an elbow driver including a stepper motor configured to drive geared belts connected to geared elbow pulleys fixed to the lower arm.

19. A system according to claim 18, wherein:

said second drive unit includes an air cylinder configured to translate said first drive unit and said arm.

20. A method of winding wire with a wire take-up unit, the take-up unit including a rotatable first mandrel portion, a rotatable second mandrel portion, a third mandrel portion which is configured to alternately join with the first and second mandrel portions to form a complete mandrel on which to wind wire into a coil, and a wire directing traverse, said traverse arranged to feed wire and alternately form coils on the first and second mandrel portions when joined to the third mandrel portion, the method comprising:

feeding wire from the traverse and winding the fed wire in a figure-eight configuration to form a coil on a complete mandrel formed by joining the first and third mandrel portions; and upon formation of the coil, positioning a wire cutter/grabber unit at a cut position between said traverse and the formed coil, the cutter/grabber configured to cut the wire and grab a free end thereof, and cutting the wire at the cut position and grabbing the free end of the wire extending from the traverse;

separating the first mandrel portion from the third mandrel portion, leaving the formed coil solely on the first mandrel portion and exchanging positions between the first mandrel portion and the second mandrel portion; and moving the cutter/grabber with the free end of the wire along a predefined cutter/grabber pathway to a hand-off position where the free end of the wire is transferred from the cutter/grabber to the second mandrel portion;

joining the second mandrel portion with the third mandrel portion to form another complete mandrel; and moving the cutter/grabber along the cutter/grabber pathway from the hand-off position to a ready-to-wind position, wherein as the cutter/grabber is moved along the cutter/grabber pathway from the cut position to the hand-off position, the length of wire between said traverse and the free end of the wire does not decrease, and the length of wire between the traverse and the free end of the wire is longer at the hand-off position than at the cut position.

21. The method according to claim 20, wherein:

joining the second mandrel portion with the third mandrel portion occurs simultaneously with moving the cutter/grabber from the hand-off position to the ready-to-wind position.

22. The method according to claim 20, further comprising:

upon the cutter/grabber moving to the ready-to-wind position, winding wire in a figure-eight configuration to form a coil on the other complete mandrel that includes the second and third mandrel portions joined together.

* * * * *